US007320405B2

(12) United States Patent
Stahl

(10) Patent No.: US 7,320,405 B2
(45) **Date of Patent: *Jan. 22, 2008**

(54) MULTI-LEVEL STACKING/NESTING TRAY

(75) Inventor: Edward L. Stahl, Tyler, TX (US)

(73) Assignee: Norseman Plastics, Ltd., Rexdale, Ontario (CA)

( * ) Notice: Subject to any disclaimer, the term of this patent is extended or adjusted under 35 U.S.C. 154(b) by 121 days.

This patent is subject to a terminal disclaimer.

(21) Appl. No.: 10/275,735

(22) PCT Filed: May 9, 2001

(86) PCT No.: PCT/CA01/00640

§ 371 (c)(1),
(2), (4) Date: Jun. 17, 2003

(87) PCT Pub. No.: WO01/85558

PCT Pub. Date: Nov. 15, 2001

(65) Prior Publication Data

US 2004/0060844 A1 Apr. 1, 2004

(51) Int. Cl.
*B65D 21/00* (2006.01)
*B65D 85/62* (2006.01)

(52) U.S. Cl. ..... 206/509; 206/519

(58) Field of Classification Search ..... 206/507, 206/509, 505, 511, 518, 519, 520; 220/4.27
See application file for complete search history.

(56) References Cited

U.S. PATENT DOCUMENTS 2,026,204 A 12/1935 Andrews (Continued)

FOREIGN PATENT DOCUMENTS

CA 892971 2/1972

(Continued)

OTHER PUBLICATIONS

Canadian Office Action issued Nov. 24, 2005 in Canadian Application No. 2,408,247.

(Continued)

*Primary Examiner*—Anthony D. Stashick
*Assistant Examiner*—Harry A. Grosso
(74) *Attorney, Agent, or Firm*—Katten Muchin Rosenman LLP; Mark W. Hrozenchik; Richard P. Bauer

(57) ABSTRACT

A novel container (20) for transport or storage of products such as bread, buns, or other goods. In one embodiment, there is provided a nestable container with a base (24) and sidewalls (28, 32) that can be stacked in two positions for different products and can be nested when empty for compact storage. The container has levered positions for lifting out of each stacking position and into a corresponding sliding position. The sliding positions can be used to offset the container or containers from the stack and reduce the strain on the operator when lifting for destacking. Alternatively, the container can slide in the opposite direction for stacking in either position. Thus the operator can set the container down, offset from the stack, in the sliding position and slide into stacking position. Back strain can be reduced during stacking and destacking as the operator does not have to extend or lean over the stack to pick up or set down the containers.

34 Claims, 24 Drawing Sheets

U.S. PATENT DOCUMENTS

| | | | | |
|---|---|---|---|---|
| 2,029,746 | A | 2/1936 | Tufts et al. | |
| 2,061,414 | A | 11/1936 | Tufts et al. | |
| 2,389,010 | A | 11/1945 | Traumuller | |
| 2,442,723 | A | 6/1948 | Economakis | |
| 2,457,841 | A * | 1/1949 | Smith et al. | 220/1.5 |
| 2,457,842 | A * | 1/1949 | Smith et al. | 220/1.5 |
| 2,641,383 | A | 8/1953 | Coursey | |
| 3,375,953 | A | 4/1968 | Miller, Jr. | |
| 3,379,339 | A | 4/1968 | Asenbauer | |
| 3,387,740 | A | 6/1968 | Bockenstette | |
| 3,392,875 | A | 7/1968 | Bockenstette | |
| 3,420,402 | A | 1/1969 | Frater et al. | |
| 3,421,656 | A | 1/1969 | Asenbauer | |
| 3,507,697 | A | 4/1970 | Korman | |
| 3,659,743 | A | 5/1972 | Box | |
| 3,752,352 | A | 8/1973 | Senecal | |
| 3,780,905 | A | 12/1973 | Herolzer | |
| D236,168 | S | 7/1975 | Johnson | |
| 3,907,111 | A | 9/1975 | Levenhagen | 206/511 |
| 3,934,724 | A | 1/1976 | Johnson | |
| 3,951,265 | A | 4/1976 | Carroll | |
| 3,952,903 | A | 4/1976 | Sanders et al. | |
| 3,993,211 | A | 11/1976 | Astle | |
| 4,000,817 | A | 1/1977 | Sanders et al. | |
| 4,093,070 | A | 6/1978 | Stahl | |
| 4,093,071 | A | 6/1978 | Stahl et al. | |
| 4,102,453 | A | 7/1978 | Carroll et al. | |
| 4,105,117 | A | 8/1978 | Atkin et al. | |
| 4,106,623 | A | 8/1978 | Carroll et al. | |
| 4,106,624 | A | 8/1978 | Thurman | |
| 4,106,625 | A | 8/1978 | Carroll et al. | |
| 4,109,791 | A | 8/1978 | Clipson et al. | |
| 4,189,052 | A | 2/1980 | Carroll et al. | |
| 4,194,626 | A | 3/1980 | Boller | 206/509 |
| 4,211,327 | A | 7/1980 | Stahl et al. | |
| D258,050 | S | 1/1981 | Cornou | |
| 4,247,004 | A | 1/1981 | Bird | |
| 4,249,671 | A | 2/1981 | Crolli | |
| 4,320,837 | A | 3/1982 | Carroll et al. | |
| D269,017 | S | 5/1983 | Martin | |
| 4,391,369 | A | 7/1983 | Stahl et al. | |
| 4,423,813 | A | 1/1984 | Kreeger et al. | |
| 4,426,001 | A | 1/1984 | Stahl et al. | |
| 4,440,302 | A | 4/1984 | Ehrman et al. | |
| 4,466,541 | A | 8/1984 | Tabler et al. | |
| 4,520,928 | A | 6/1985 | Wilson | |
| 4,523,681 | A | 6/1985 | Kreeger | |
| 4,573,577 | A | 3/1986 | Miller | |
| 4,577,759 | A | 3/1986 | Kreeger | |
| 4,600,103 | A | 7/1986 | Tabler | |
| 4,601,393 | A | 7/1986 | Veenman et al. | |
| RE32,223 | E | 8/1986 | Kreeger et al. | |
| 4,619,366 | A | 10/1986 | Kreeger | |
| 4,619,371 | A | 10/1986 | Rehrig | |
| 4,643,310 | A | 2/1987 | Deaton et al. | |
| 4,671,411 | A | 6/1987 | Rehrig et al. | |
| D292,634 | S | 11/1987 | Chabot | |
| 4,848,578 | A | 7/1989 | Schafer | |
| 4,905,833 | A | 3/1990 | Kreeger et al. | |
| 4,936,458 | A | 6/1990 | Tabler et al. | |
| 4,960,207 | A * | 10/1990 | Tabler et al. | 206/507 |
| 4,982,844 | A | 1/1991 | Madan et al. | |
| 5,035,326 | A | 7/1991 | Stahl | |
| D319,908 | S | 9/1991 | Stahl | |
| D320,298 | S | 9/1991 | Apps et al. | |
| 5,163,587 | A | 11/1992 | Apps et al. | |
| D334,412 | S | 3/1993 | Feer | |
| D343,042 | S | 1/1994 | Apps et al. | |
| D344,387 | S | 2/1994 | Holliday | |
| 5,287,966 | A | 2/1994 | Stahl | |
| D348,138 | S | 6/1994 | Lang-Ree et al. | |
| D348,342 | S | 6/1994 | Lang-Ree et al. | |
| D348,343 | S | 6/1994 | Lang-Ree et al. | |
| D350,028 | S | 8/1994 | Apps | |
| D350,437 | S | 9/1994 | Apps et al. | |
| 5,344,021 | A | 9/1994 | Rose | |
| 5,344,022 | A | 9/1994 | Stahl | 206/507 |
| 5,372,257 | A | 12/1994 | Beauchamp et al. | |
| D354,167 | S | 1/1995 | Stahl | |
| 5,377,858 | A | 1/1995 | Morris, Sr. | |
| 5,415,293 | A | 5/1995 | Ackermann et al. | |
| 5,469,986 | A | 11/1995 | Jang | |
| 5,494,163 | A | 2/1996 | Apps | |
| D374,555 | S | 10/1996 | McMath | |
| 5,582,296 | A | 12/1996 | Beauchamp et al. | |
| 5,609,254 | A | 3/1997 | Loftus et al. | |
| D379,718 | S | 6/1997 | Raghunathan | |
| D381,203 | S | 7/1997 | Ackermann et al. | |
| D384,975 | S | 10/1997 | Jackson | |
| 5,735,431 | A | 4/1998 | LeTrudet | |
| 5,752,602 | A | 5/1998 | Ackermann et al. | 206/507 |
| 5,772,033 | A | 6/1998 | Loftus et al. | |
| D398,448 | S | 9/1998 | Zanni | |
| 5,816,406 | A | 10/1998 | Jupille et al. | 206/561 |
| D400,711 | S | 11/1998 | Hwang | |
| D401,066 | S | 11/1998 | Ackermann | |
| D401,412 | S | 11/1998 | LeTrudet | |
| 5,860,527 | A | 1/1999 | Frankenberg et al. | 206/509 |
| 5,881,902 | A * | 3/1999 | Ackermann | 206/509 |
| 5,896,987 | A | 4/1999 | Bettenhausen | 206/370 |
| 5,975,324 | A | 11/1999 | Schmitt | |
| 5,992,673 | A | 11/1999 | Hwang | |
| D420,219 | S | 2/2000 | Jensen et al. | |
| 6,036,049 | A | 3/2000 | Hwang | |
| D423,217 | S | 4/2000 | Varfeldt | |
| D424,299 | S | 5/2000 | Varfeldt | |
| D429,565 | S | 8/2000 | Aiken | |
| 6,098,827 | A | 8/2000 | Overholt et al. | |
| D436,729 | S | 1/2001 | Aiken | |
| D439,049 | S | 3/2001 | Koefelda | |
| 6,209,742 | B1 | 4/2001 | Overholt et al. | |
| 6,250,490 | B1 | 6/2001 | Loftus | |
| D444,950 | S | 7/2001 | Hwang | |
| 6,260,706 | B1 * | 7/2001 | Koefelda | 206/505 |
| D446,017 | S | 8/2001 | Koefelda | |
| D446,939 | S | 8/2001 | Koefelda | |
| 6,273,259 | B1 | 8/2001 | Stahl | |
| 6,293,418 | B1 | 9/2001 | Ogden et al. | |
| 6,308,858 | B1 | 10/2001 | Koefelda | |
| 6,338,181 | B1 | 1/2002 | Hwang | |
| 6,386,388 | B1 | 5/2002 | Overholt | |
| 6,394,274 | B1 | 5/2002 | Cheeseman | |
| 6,398,054 | B1 | 6/2002 | Overholt et al. | |
| D460,619 | S | 7/2002 | Koefelda | |
| D463,667 | S | 10/2002 | Hwang | |
| D477,146 | S | 7/2003 | Hwang | |
| D478,421 | S | 8/2003 | Overholt | |
| 6,601,724 | B1 | 8/2003 | Koefelda et al. | |
| 6,607,199 | B2 | 8/2003 | Gruber | |
| 6,631,822 | B1 | 10/2003 | Overholt | |
| 6,811,125 | B1 | 11/2004 | Koefelda et al. | |
| 6,857,642 | B2 | 2/2005 | Gruber | |
| 6,880,705 | B2 | 4/2005 | Otting et al. | |
| 6,886,710 | B2 | 5/2005 | Verna et al. | |
| 6,918,502 | B1 | 7/2005 | Overholt et al. | |
| 6,918,508 | B2 | 7/2005 | Hwang | |
| 7,044,319 | B2 | 5/2006 | Overholt et al. | |
| 7,104,553 | B2 | 9/2006 | Gruber | |
| 2002/0056717 | A1 | 5/2002 | Hwang | |
| 2002/0130132 | A1 | 9/2002 | Overholt | |
| 2002/0153682 | A1 | 10/2002 | Gruber | |

| | | | |
|---|---|---|---|
| 2004/0050742 | A1 | 3/2004 | Gruber |
| 2006/0070906 | A1 | 4/2006 | Verna |

FOREIGN PATENT DOCUMENTS

| | | | |
|---|---|---|---|
| CA | 1273881 | | 9/1990 |
| CA | 2032012 | | 6/1991 |
| CA | 2130973 | | 1/1995 |
| CA | 2129617 | | 2/1995 |
| CA | 2212239 | | 8/1996 |
| CA | 2484830 | | 8/1996 |
| CA | 2313137 | | 7/1999 |
| CA | 2296895 | | 7/2000 |
| CA | 2 389 010 | A1 | 3/2001 |
| CA | 2326118 | | 5/2001 |
| CA | 2387491 | | 5/2001 |
| CA | 2392265 | | 6/2001 |
| CA | 2395367 | | 7/2001 |
| CA | 2397522 | | 8/2001 |
| CA | 2384941 | | 1/2002 |
| CA | 2421595 | | 3/2002 |
| CA | 2426949 | | 5/2002 |
| CA | 2442723 | | 10/2002 |
| CA | 2455355 | | 2/2003 |
| CA | 2458773 | | 3/2003 |
| CA | 2472360 | | 7/2003 |
| CA | 2475531 | | 9/2003 |
| CA | 2485544 | | 12/2003 |
| CA | 2248920 | | 7/2004 |
| EP | 0370771 | A2 * | 5/1990 |
| FR | 1131652 | | 10/1956 |
| FR | 2678585 | | 8/1993 |
| GB | 2067167 | | 7/1981 |
| GB | 2129401 | | 5/1984 |
| GB | 2137167 | | 10/1984 |
| GB | 2141778 | | 1/1985 |
| GB | 2171980 | | 9/1986 |
| GB | 2180821 | | 4/1987 |
| TW | 338405 | | 8/1998 |
| TW | 372539 | | 10/1999 |
| WO | 00/0027716 | | 5/2000 |
| WO | 00/66440 | | 11/2000 |
| WO | 01/085558 | | 11/2001 |

OTHER PUBLICATIONS

European Patent Office Action dated May 27, 2004 (2 pages).
European Patent Office Action Jun. 2, 2005 (2 pages).
Mexican Foreign Associate Letter dated May 9, 2006 with copy of Mexican Office Action issued in Mexican Appln. No. 2011009 dated Apr. 12, 2006 (5 pages).
Office Action dated May 27, 2004, issued in EP Application No. 01 931 263.6-2308 (2 pages).
Office Action dated Jun. 2, 2005, issued in EP Application No. 01 931 263.6-2308 (3 pages).
Office Action dated Jan. 16, 2006, issued in Canadian Application No. 2,448,920 (2 pages).
Iper; PCT/CA01/00640; Sep. 10, 2002; 11 pages.
Mexican Official Action; Pa/a/2002/011009; Apr. 12, 2006; 4 pages.

* cited by examiner

MULTI-LEVEL STACKING/NESTING TRAY

FIELD OF THE INVENTION

The present invention relates to injection molded containers. In particular, the present invention relates to a transport and storage container.

BACKGROUND OF THE INVENTION

Many transport and storage containers are known. Certain containers are used to transport and store goods such as bread or buns and other foods. Containers are typically injection molded plastic and rectangular in shape.

Containers for transportation and storage of bread products commonly have a base with a protruding base edge, a pair of opposing long sidewalls, and a pair of opposing short sidewalls. The sidewalls protrude in the opposite direction of the base edge. The opposing long sidewalls generally do not protrude as far from the base as the short sidewalls and may have a merchandiser or open section for viewing the contents held therein. The containers are stackable such that the base edge of one container is typically received by a complimentary configuration on the opposing short sidewalls of a second container. The base of the container can have a plurality of apertures for material and weight reduction. Similarly, each short sidewall commonly has a plurality of apertures and a handle in the centre for gripping the container.

When stacking, the container is gripped by placing one hand on each handle. The container is centred above a second container and placed directly down such that the base edge of the first container is received by the footprint of the second container. Similarly, when removing one container from a stack, the container is gripped by placing one hand on each handle. The container is then lifted away from and in a direction normal to the complimentary container. Because of the configuration of the container, stacking and destacking can be awkward and ergonomically unsafe as the person lifting the container can experience lower back strain. The operator carries the load with extended arms to place the container into a stack or when removing from a stack. The container is even more awkward to destack when full. If the operator removes more than one container when destacking, the potential for back strain is further increased.

When moving many containers at one time, a two wheeled cart is typically used. In order to slide the blade edge of the cart under the container it is generally preferred to tilt the stack of containers so that the blade will run under the stack. A stack of containers can be difficult to tilt forward while manoeuvring a two wheeled cart into place. It can be even more difficult to tilt the stack of containers due to lack of space in a packed truck. The cart also applies pressure to the base of the bottom container of the stack. This causes flexing of the base of the container thus crushing the contents of the bottom container. Overall, using a two wheeled cart to lift a stack of containers can be awkward and/or can damage the container.

SUMMARY OF THE INVENTION

It is an object of the present invention to provide a novel container that obviates or mitigates at least one of the disadvantages of the prior art.

In one aspect of the invention there is provided a container with a base and at least one pair of opposing sidewalls. The sidewalls have a rail edge distal from the base and a plurality of receptacles. The sidewalls have runners complementary to the receptacles that project from an edge adjacent the base. The sidewalls also have a fulcrum at the junction of a rail edge and one of the receptacles. The container has a stacked position with an identical container when the runners are received in complementary receptacles of the identical container. The container has a sliding position when the runners abut a rail edge of the identical container. The container has a levered position intermediate the stacked and sliding positions when the runner respective to a fulcrum of the identical container is pivoted thereon. In a preferred embodiment of the first aspect, there are two outer runners, or feet, and a central runner respective to the fulcrum.

In a second aspect of the invention there is provided a container with a base and at least one pair of opposing sidewalls projecting normally from the base. The sidewalls have a base edge proximal to the base and a distal edge opposite the base edge. One of the base edge and the distal edge has a plurality of receptacles and the opposite one has a plurality of runners complementary to the receptacles. The sidewalls also have a fulcrum at a junction of one of the receptacles and the respective edge. The container has a stacked position with an identical container when the runners are received in complementary receptacles of the identical container.

The container has a sliding position when the runners abut the opposite edge of the identical container. The container has a levered position intermediate the stacked and sliding positions when the runner respective to the fulcrum of the identical container is pivoted thereon.

In a third aspect of the invention there is provided a container with a base and a pair of opposing sidewalls projecting normally from the base. A pair of opposing long walls project normally from the base and extend between the pair of opposing sidewalls. A skirt around the periphery of the base interconnects the base with the sidewalls and the base with the long walls. The skirt is further defined by an outward taper and a pair of notches between each of the long sides and the base. The base comprises a grid of interconnected, inverted u-shaped channels. The u-shaped channels have at least one closed end and two opposing sides. The sidewalls have a rail and a rail edge distal from the base. The rail edge has a plurality of foot receptacles with a bevelled edge and at least one runner receptacle. The sidewalls have feet with a bevelled edge that are complementary to the foot receptacles and project from an edge proximal to the base. The sidewalls have at least one runner complementary to the runner receptacle that projects from the edge proximal to the base. Each of the opposing sidewalls have at least one handle with finger grips on one of the opposing sidewalls. One of the opposing sidewalls also has a serrated edge distal from the base and adjacent to the rail. The container has a fulcrum at a junction of the rail edge and the runner receptacle. The container has a first stacked position with an identical container when the feet are received in complementary foot receptacles of the identical container and the runner is received in complementary runner receptacle of the identical container. The container has a first sliding position, in relation to a second identical container, when the runner abuts the rail edge of the identical container. The container also has a first levered position, in relation to a second identical container, that is intermediate the first stacked and first sliding positions and the runner respective to a fulcrum of the identical container is pivoted thereon. The container has a second stacking position when the feet are received in complementary foot receptacles of an opposite sidewall of the identical container. The container has a second sliding position when the feet abut the rail on the opposite sidewall of the identical container. The container also has a second levered position intermediate the second stacked and second sliding positions when one of the feet respective to one foot receptacle on the opposite sidewall of the second container is pivoted thereon.

In another aspect of the invention there is provided a container comprising a base, a sidewall projecting from the base and comprising an upper edge, a recess, and a fulcrum disposed between the upper edge and the recess, a foot depending from the sidewall, wherein the foot is configured to reside in the recess of an identical container and to be pivotable against the fulcrum of the identical container.

In a further aspect of the invention there is provided a container comprising a base, including a locator hole, a sidewall, including a locator pin depending therefrom, wherein the locator pin is configured to be received within the locator hole in an identical container.

In yet another aspect of the invention, there is provided a container comprising a base, first and second opposed sidewalls projecting from the base, each of the first and second sidewalls including a recessed channel, and a foot depending therefrom, wherein the foot is configured to reside in the channel of an identical container, and a third sidewall projecting from the base and extending between the first and second sidewalls comprising a second foot depending from the third sidewall, a support surface including a floor, and an upstanding wall extending from the floor and presenting a surface substantially parallel with the third sidewall, wherein the support surface is configured to support the second foot of an identical container.

A novel container for transport or storage of products such as bread, buns, or other goods. In one embodiment, there is provided a nestable container with a base and sidewalls that can be stacked in two positions for different products and can be nested when empty for compact storage. The container has levered positions for lifting out of each stacking position and into a corresponding sliding position. The sliding positions can be used to offset the container or containers from the stack and reduce the strain on the operator when lifting for destacking. Alternatively, the container can slide in the opposite direction for stacking. Thus the operator can set the container down (offset from the stack) in the sliding position and then slide into stacking position. Back strain can be reduced during stacking and destacking as the operator does not have to extend or lean over the stack to pick up or set down the containers.

BRIEF DESCRIPTION OF THE DRAWINGS

Preferred embodiments of the present invention will now be described, by way of example only, with reference to the attached Figures, wherein:

FIG. 18 is a detailed view of the junction between;

FIG. 19 is a second detailed view of the junction between;

DETAILED DESCRIPTION OF THE INVENTION

Figure 1:
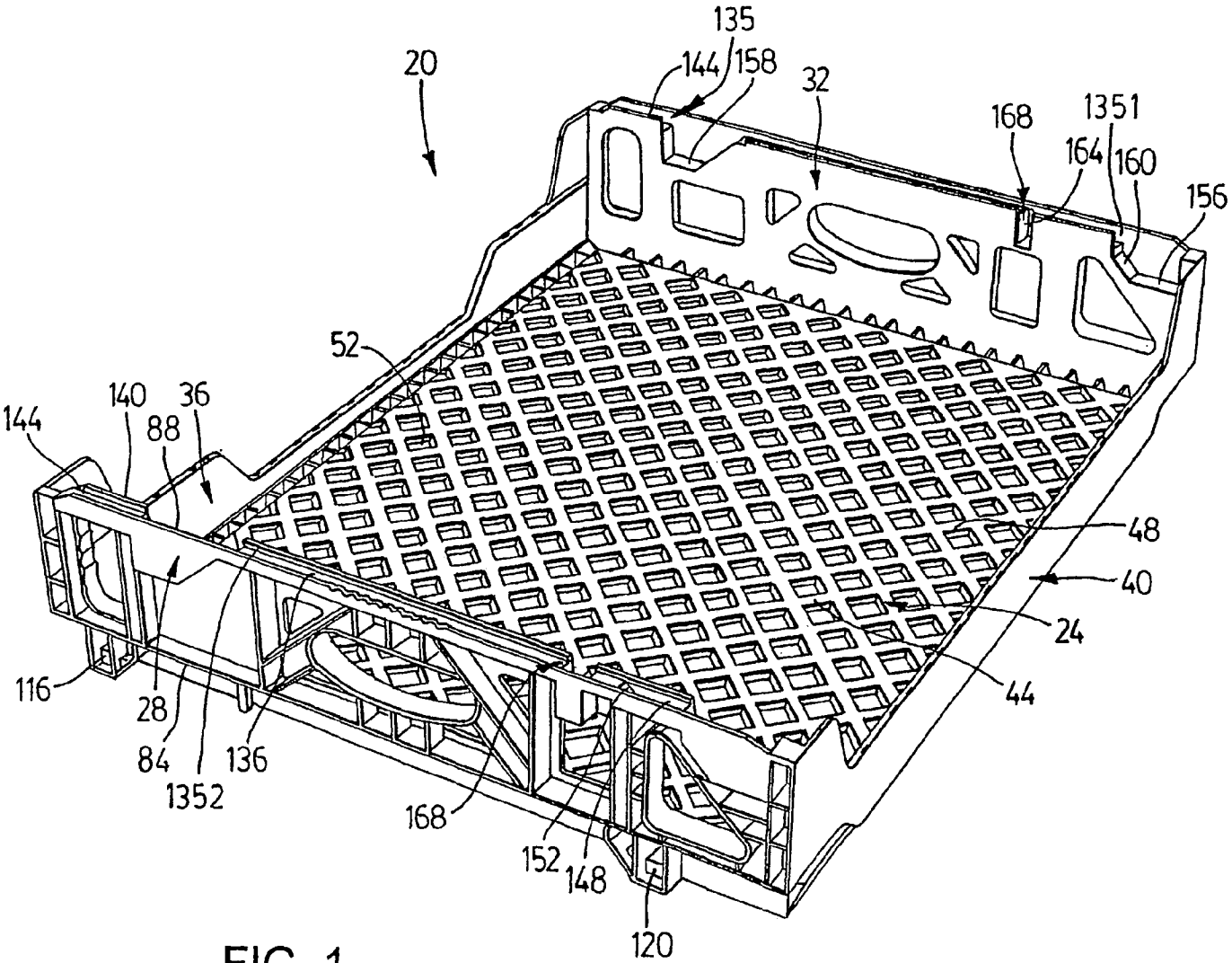
FIG. 1 is a top perspective view of the container, in accordance with a first embodiment of the invention.

Referring to FIG. 1, a container in one embodiment of the invention is indicated generally at 20. Container 20 is preferably used to transport and/or store products such as bread or buns. In a present embodiment, container 20 is an injection-molded polymer such as high-density polyethylene but other materials and forming processes can be used. Container 20 comprises a substantially rectangular base 24 and two sidewalls 28, 32 that project substantially normal to base 24. Opposing long sides 36, 40 extend between sidewalls 28, 32 and project substantially normal to base 24.

Figure 2:
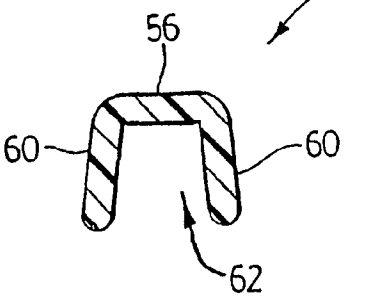
FIG. 2 is a sectional view of the u-shaped channel of the base of the container of FIG. 1.

Base 24 is slightly bowed such that it has a convex side 44 towards the interior of container 20. Base 24 is comprised of a grid of interconnected inverted u-shaped channels 48. The grid of u-shaped channels 48 forms a plurality of apertures 52 in base 24. As best seen in FIG. 2, u-shaped channels 48 have a closed end 56 and two opposing sides 60 extending therefrom. Closed end 56 and opposing sides 60 form channel opening 62. Channel 48 is tapered such that each of opposing sides 60 is at an obtuse angle with end 56. It is believed that the angle can be from about one degree to about fifteen degrees with respect to the normal from closed end 56. Preferably, the angle is from about two degrees to about ten degrees with respect to the normal from closed end 56. More preferably, the angle is about three degrees with respect to the normal from closed end 56.

Figure 3:
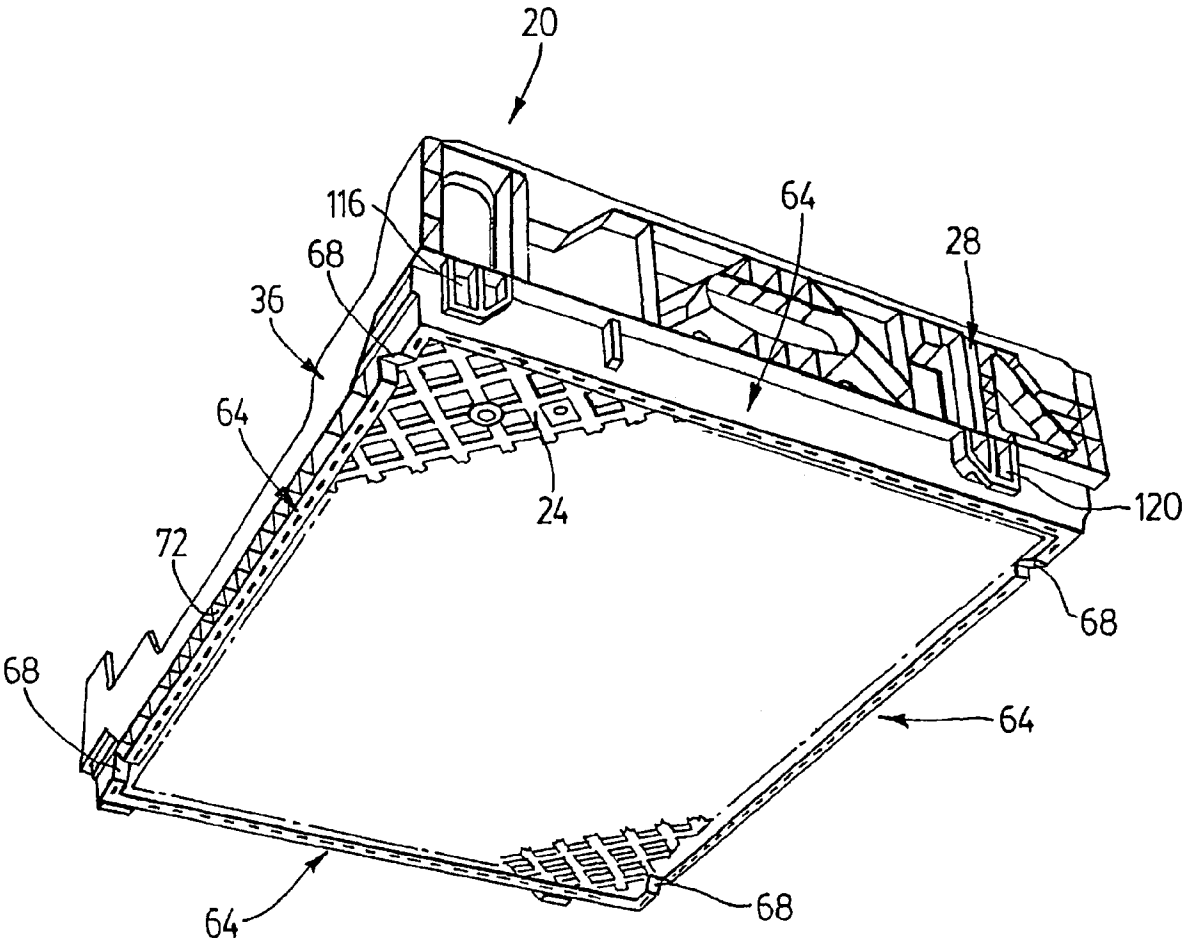
FIG. 3 is a bottom perspective view of the container of FIG. 1.

Referring to FIG. 3, a skirt 64 runs along the periphery of base 24 and interconnects base 24 with sidewalls 28, 32 and long sides 36, 40. There are two notches 68 in skirt 64 between each of long sides 36, 40 and base 24.

Figure 4:
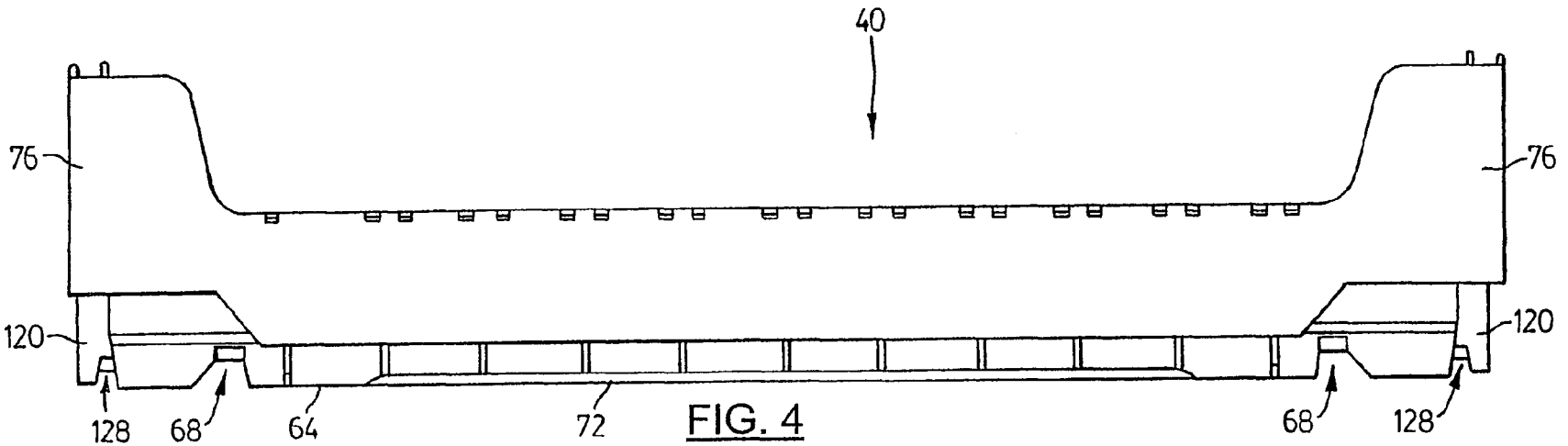
FIG. 4 is a rear view of the container of FIG. 1.
Figure 5:
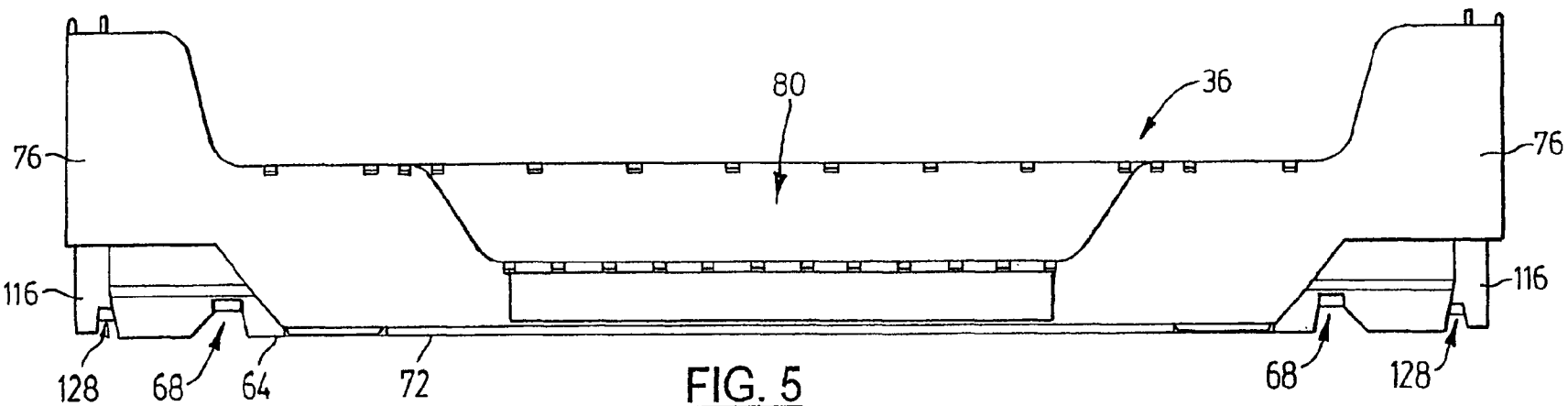
FIG. 5 is a front view of the container of FIG. 1.

Referring now to FIGS. 4 and 5, long side 40 is substantially rectangular with a flange 76 on each end adjoining sidewalls 28, 32. Similarly, long side 36 has flange 76 on each end adjoining sidewall 28, 32. A substantially rectangular merchandiser window 80 is framed by long side 36 and flanges 76. Skirt 64 is further defined by an outward taper 72 that runs adjacent to long sides 36, 40 and is for slideably receiving the blade of a two-wheeled cart.

Figure 6:
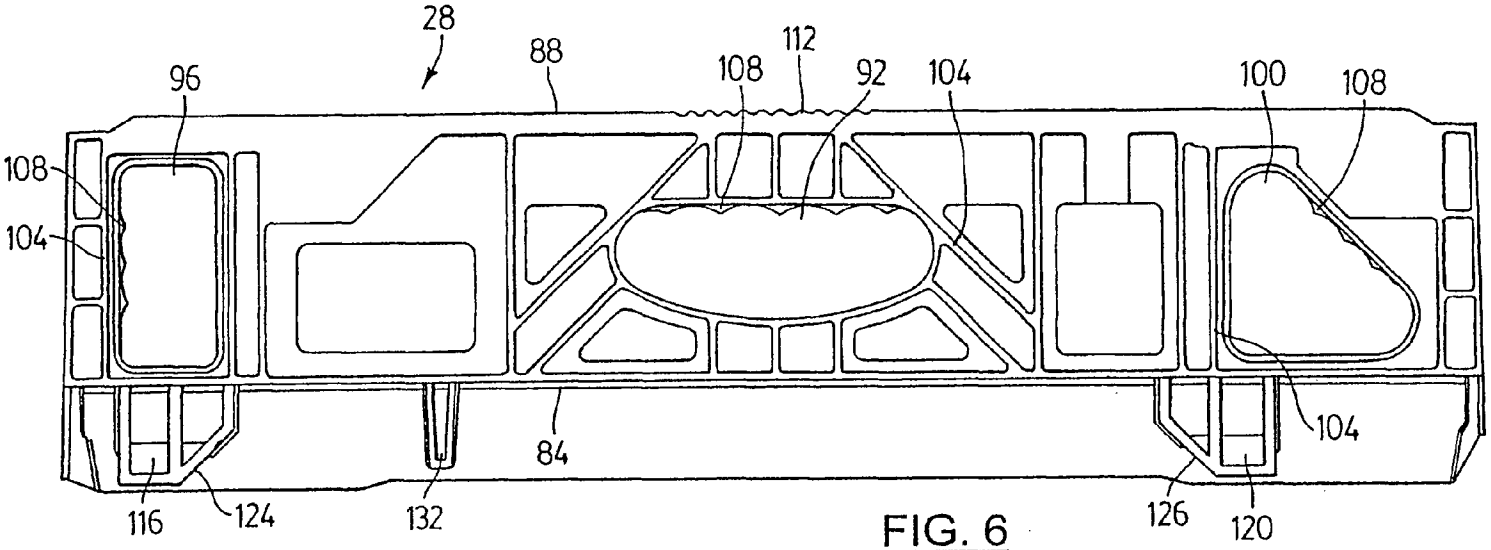
FIG. 6 is a right side view of the container of FIG. 1.
Figure 7:
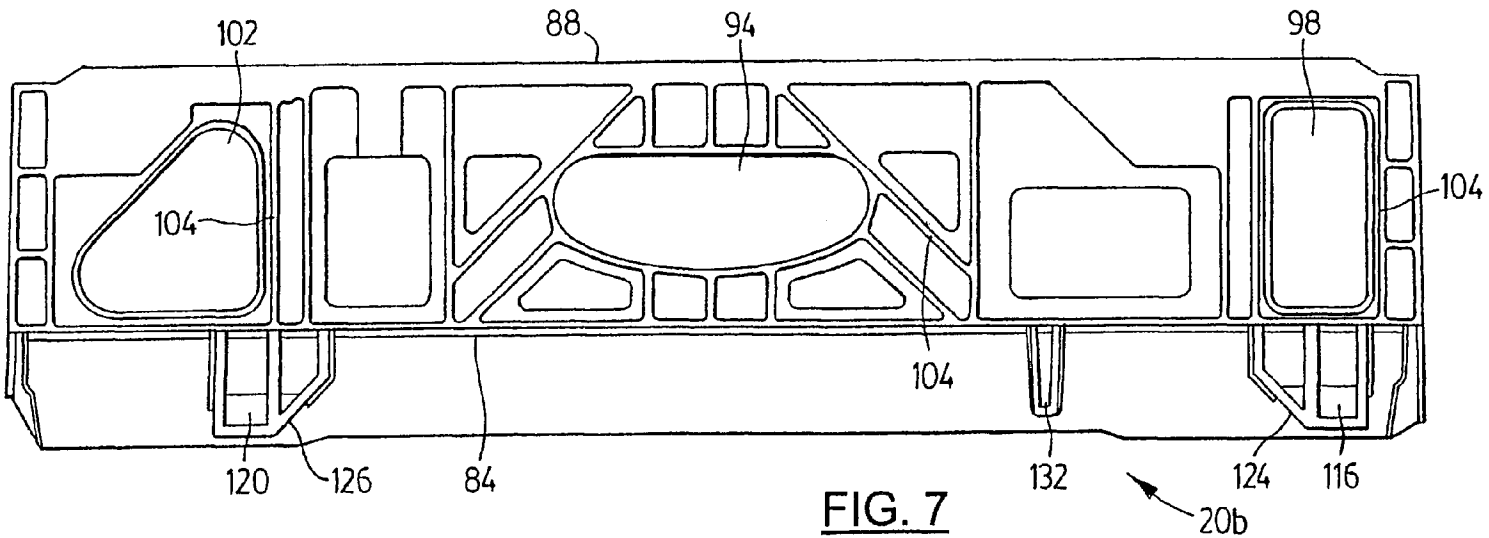
FIG. 7 is a left side view of the container of FIG. 1.

Referring to FIGS. 6 and 7, sidewalls 28, 32 are substantially rectangular with a base edge 84 and a first rail edge 88 opposite base edge 84. Sidewall 28 has a central handle 92 substantially centred on sidewall 28. Also, sidewall 28 has a rectangular end handle 96 at one end and a triangular end handle 100 at the opposite end. Similarly, sidewall 32 has a central handle 94 substantially centred on sidewall 32. Also, sidewall 32 has a rectangular end handle 98 at one end and a triangular end handle 102 at the opposite end. Each sidewall 28, 32 has ribs 104 proximal to each handle 92, 96, 100, 94, 98, 102 for supporting sidewalls 28, 32 and handles 92, 96, 100, 94, 98, 102. Sidewall 28 is substantially the mirror-image of sidewall 32. However, sidewall 28 has finger grips 108 respective to each handle 92, 96, 100, and a serrated edge 112, each of which can be used to identify sides 28, 32.

Referring to FIGS. 4, 5, 6 and 7, a first guide foot 116 extends from base edge 84 of each sidewall 28, 32 and is substantially aligned with rectangular handle 96, 98. Guide foot 116 is substantially rectangular with an inwardly facing bevelled edge 124. A second guide foot 120 extends from base edge 84 of each sidewall 28, 32 and is closer to central handle 92 than first guide foot 116. Each guide foot 120 is substantially rectangular with an inwardly facing bevelled edge 126. Each foot 116, 120 has a groove 128 between its extremity and skirt 64.

As best seen in FIG. 6, a substantially rectangular runner 132 is integral with skirt 64 and projects from base side 84. Runner 132 is substantially centred between central handle 92 and rectangular end handle 96. As best seen in FIG. 7, sidewall 28 and its respective guide feet 116, 120 and runner 132 are substantially the mirror image of sidewall 32.

Figure 8:
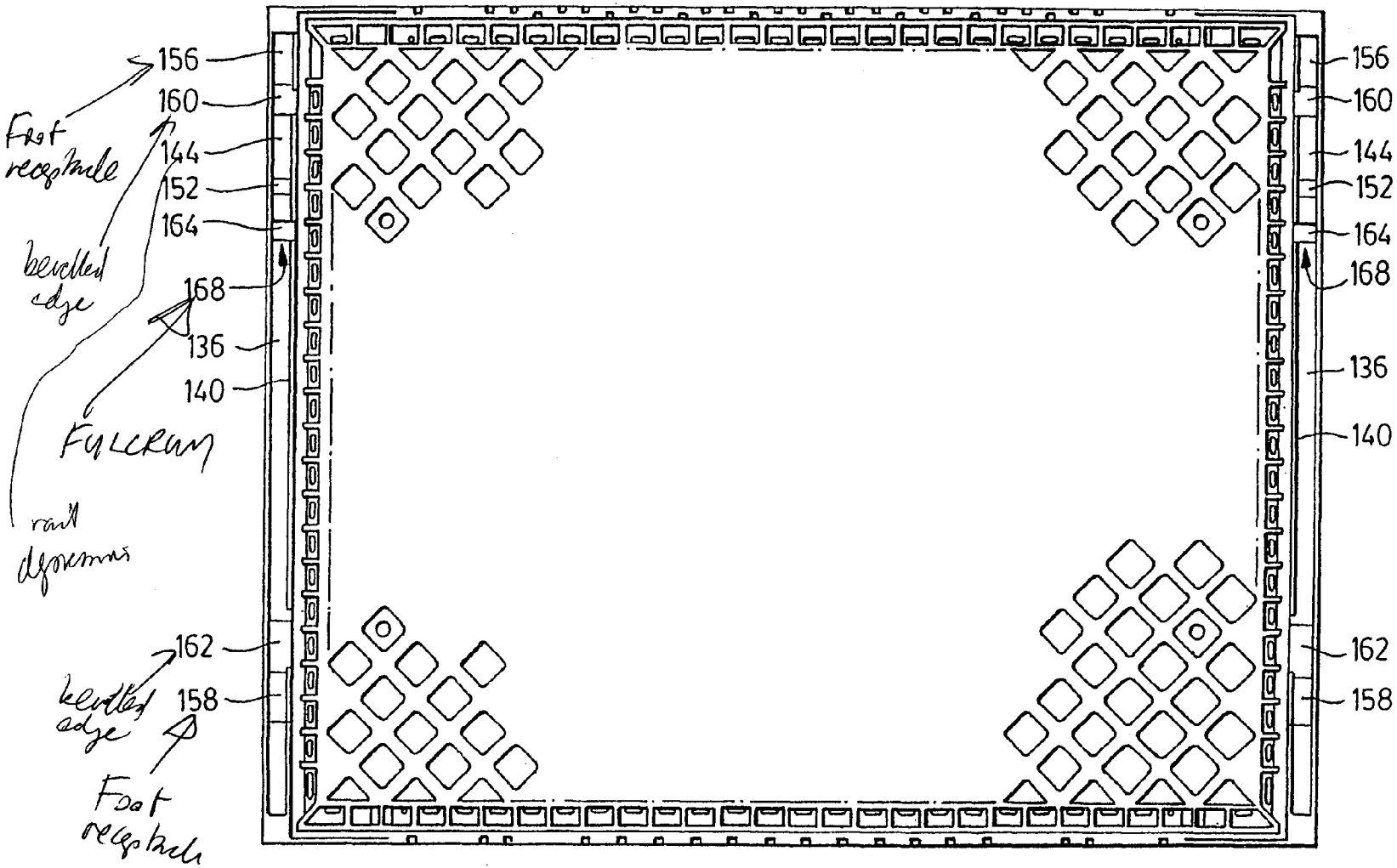
FIG. 8 is a top view of the container of FIG. 1.

As best seen in FIGS. 1 and 8, a channel 135 is recessed from first rail edge 88 and extends substantially along the inner length of each sidewall 28, 32. Each channel 135 includes inwardly facing sidewalls 1351 and 1352 extending from track 1353. Sidewall 1351 includes an upper edge, defining first rail edge 88. Similarly, sidewall 1352 includes an upper edge, defining second rail edge 140. Each channel 135 includes a rail 136, a first depression 144, a second depression 148, a first foot receptacle 156, second foot receptacle 158, and runner receptacle 164. First depression 144 is aligned with guide foot 116 on each of sidewalls 28, 32. Second depression 148 is aligned with second guide foot 120 on each of sidewalls 28, 32. Second depression 148 has an inwardly bevelled edge 152 between depression 148 and rail 136. First foot receptacle 156 is proximal to long side 40 with an inwardly bevelled edge 160. First foot receptacle 158 is configured to received guide foot 116 and permit pivotal rotation of guided foot 116 therein about end of sidewall 28 nearest rectangular handle 96, and also permit pivotal rotation of guide foot 116 about fulcrum 168, as will be further described hereafter. Second foot receptacle 158 includes an inwardly facing bevelled edge 162. Second foot receptacle 158 is closer to central handle 92 than first foot receptacle 156. Runner receptacle 164 is disposed between rail 136 and second depression 148. A fulcrum 168 intersects receptacle 164 and rail edge 140 on the side of receptacle 164 nearest to central handle 92 on each sidewall 28, 32.

The positions for transportation and storage of container 20 will now be described with reference to the foregoing and the attached Figures. Container 20 has two stacked positions shown in FIGS. 9*a* to 9*d* and FIGS. 12*a* to 12*d*, two levered positions for destacking shown in FIGS. 10 and 13, two sliding positions for stacking and destacking shown in FIGS. 11 and 14, and a nested position for storage shown in FIG. 15. In each of the above listed positions, container 20 is positioned with an identical container 20*b*. Note that all parts of container 20*b* are given the same number designations as that of container 20 but are succeeded by the label "b".

In the first stacked position, shown in FIGS. 9*a* to 9*d*, container 20 is stacked with container 20*b* such that side 28 is aligned with side 32*b*. Likewise, side 32 is aligned with side 28*b*. Each guide foot 116, 120 is received by complimentary foot receptacle 156*b*, 158*b*. Bevelled edge 124 of each guide foot 116 is adjacent to bevelled edge 160*b* of complimentary foot receptacle 156*b*. Similarly, bevelled edge 126 of each guide foot 120 is adjacent to bevelled edge 162*b* of complimentary foot receptacle 158*b*. Each runner 132 is received by complimentary runner receptacle 164*b*. In this configuration, central handle 92 is aligned with central handle 94*b*. End handles 96, 96*b*, 100, 100*b*, 98, 98*b*, 102, 102*b* are oppositely aligned such that rectangular handle 96 is aligned with triangular handle 102*b* and triangular handle 100 is aligned with rectangular handle 98*b*. Similarly, central handle 94 is aligned with central handle 92*b*. Triangular handle 102 is aligned with rectangular handle 96*b* and rectangular handle 98 is aligned with triangular handle 100*b*. Serrated edges 112 and 112*b* are on opposing sides of stacked containers 20, 20*b*. As will now be apparent to those of skill in the art, a plurality of substantially identical containers 20 can be stacked together in the first stacked position.

Figure 9A:
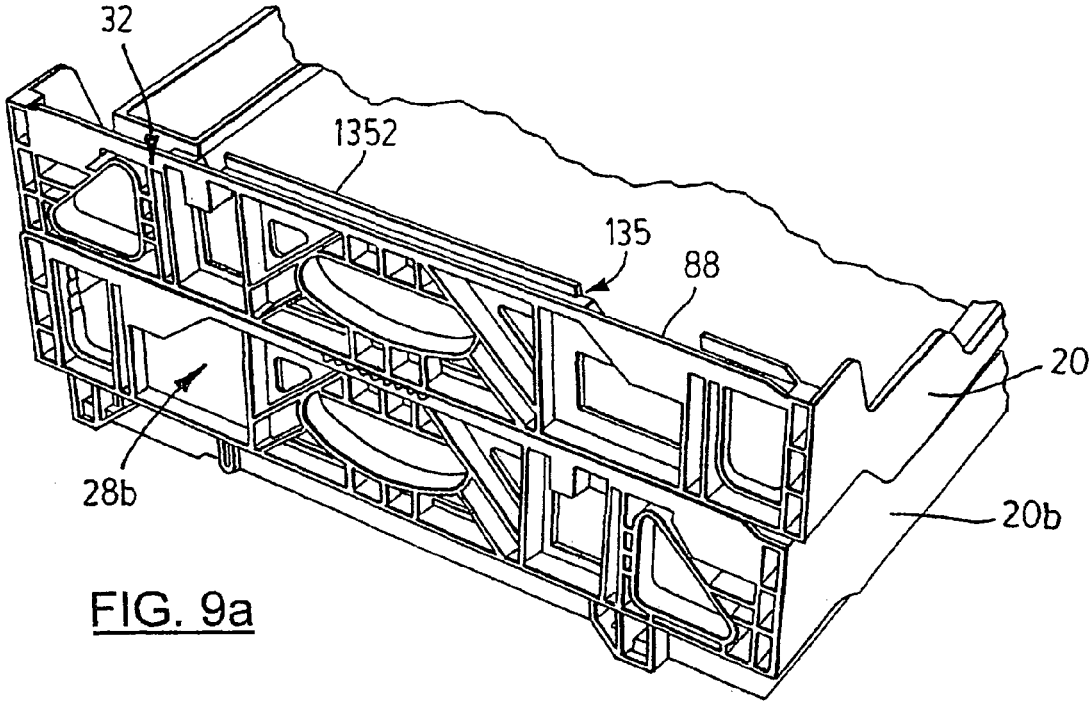
FIG. 9*a* is a partial perspective view of two of the containers of FIG. 1, stacked in first stacking position.
Figure 9B:
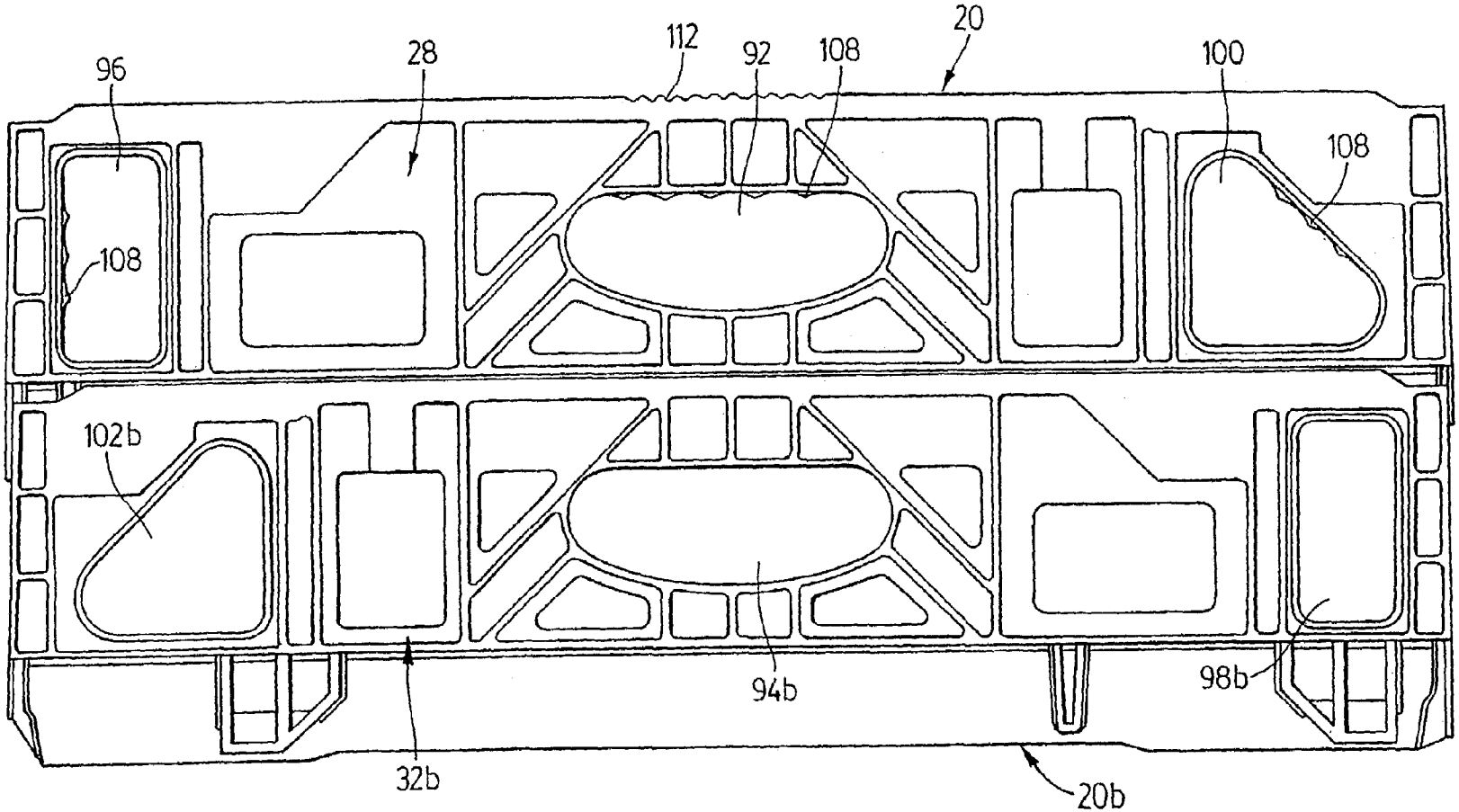
FIG. 9*b* is a side view of two of the containers stacked in a first stacking position.
Figure 9C:
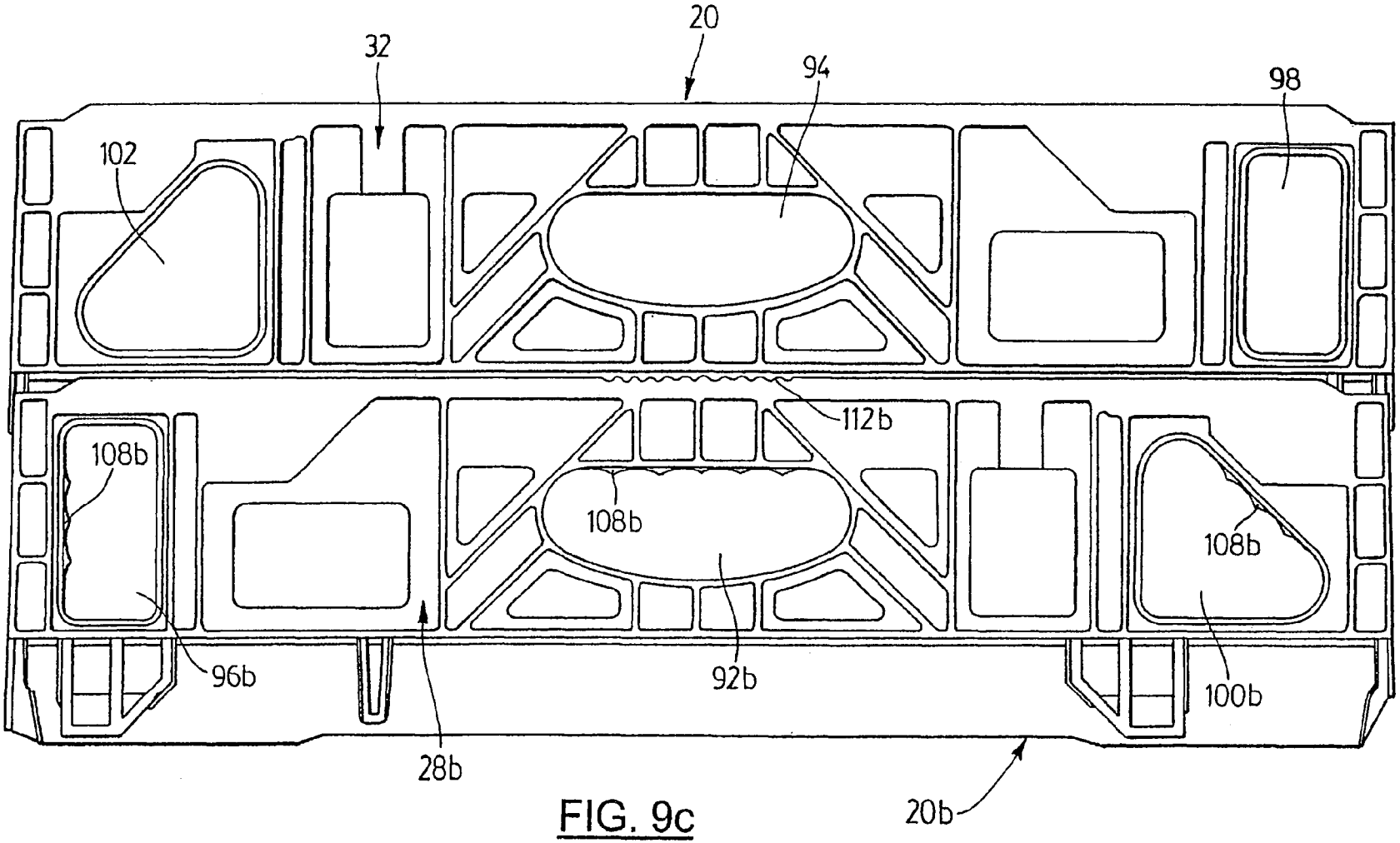
FIG. 9*c* is a side view, opposite the side view opposite the side view of FIG. 9*b*, of two of the containers stacked in the first stacking position.
Figure 9D:
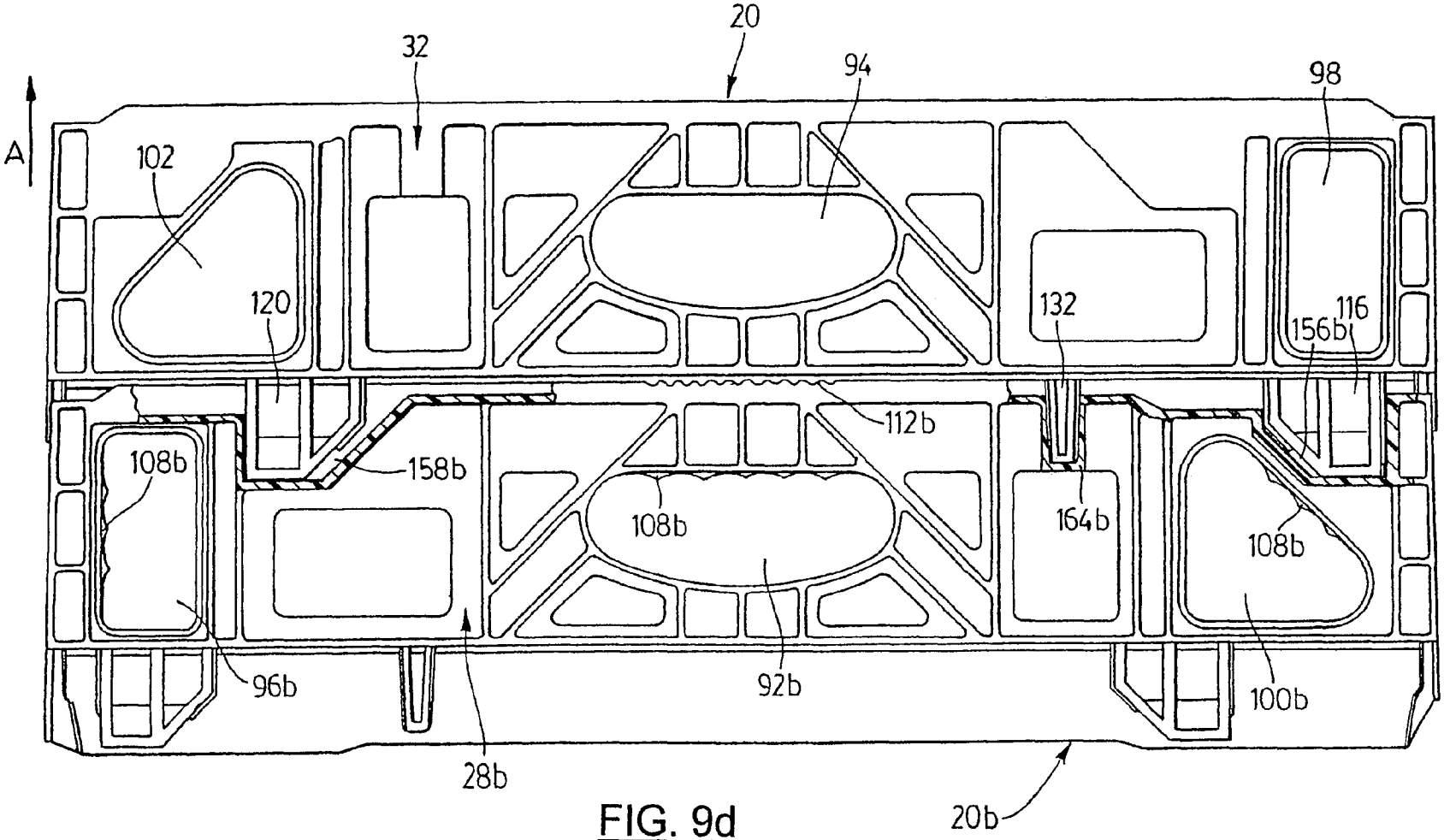
FIG. 9*d* is a partial sectional side view of two of the containers stacked in the first stacking position shown in FIG. 9*c;*
Figure 10:
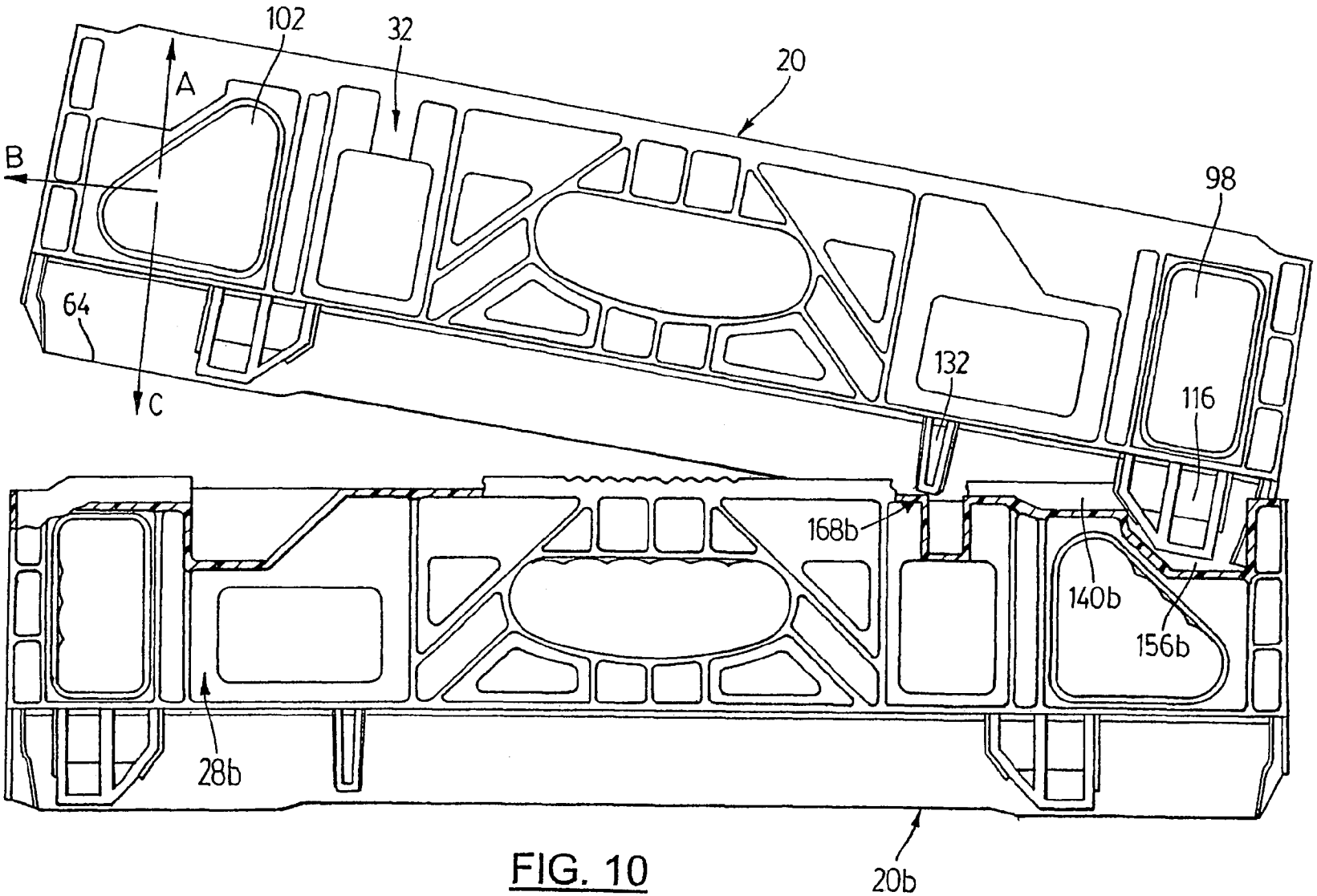
FIG. 10 is the partial sectional side view of FIG. 9*c* showing the first container in a first levered position with respect to the second container.
Figure 11:
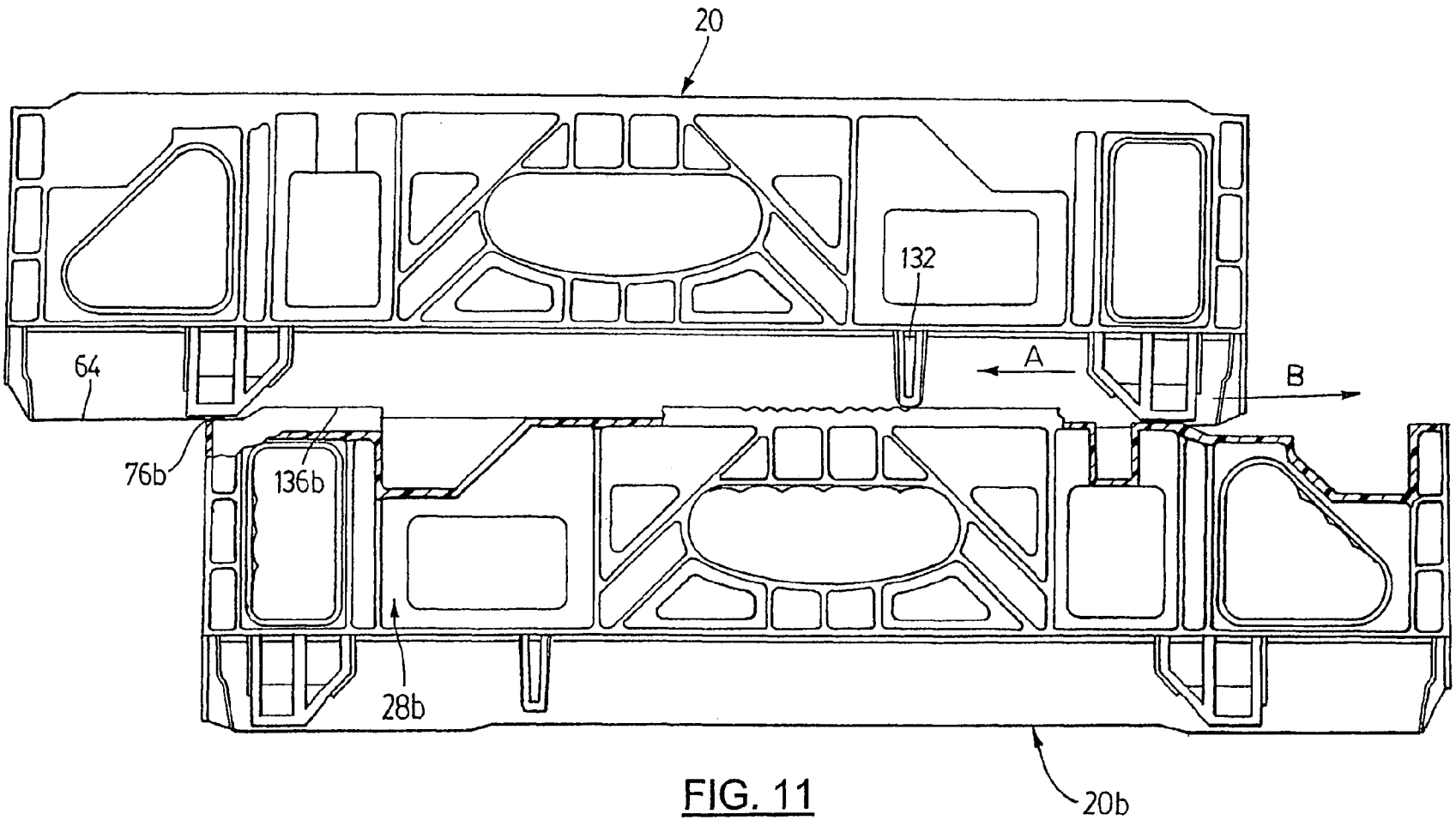
FIG. 11 is the partial sectional side view of FIG. 9*c* showing the first container in a first sliding position with respect to the second container.

Container 20 can be levered out of the first stacked position and into the first sliding position when destacking. From the first stacked position as shown in FIG. 9*d*, triangular handles 100, 102 of container 20 are grasped and container 20 is urged in the direction of arrow A. The opposing ends of sidewalls 28, 32, nearest rectangular handles 96, 98 maintains contact with respective ends of sidewalls 32*b* and 28*b* of container 20*b*. Referring to FIG. 10, container 20 is advanced in the direction of arrow B until guide foot 116 contacts rail edge 140*b*. Container 20 is then lowered in the direction of arrow C such that runner 132 contacts fulcrum 168*b*. Container 20 is urged in the direction of arrow C while a force is applied in the direction of arrow B, thereby maintaining contact between runner 132 and fulcrum 168*b* and lifting each first guide foot 116 out of respective receptacles 156*b*. When container 20 is seated again on container 20*b*, runner 132 is seated on rail 136*b* and skirt 64 is seated on flanges 76*b* of long side 40*b*, as best seen in FIG. 11. This is the first sliding position.

Referring to FIG. 11, container 20 is in the first sliding position with runner 132 seated on rail 136*b* and skirt 64 seated on flanges 76*b*. Container 20 can be urged in the direction of arrow A, for destacking or arrow B for stacking, sliding runner 132 along rail 136*b* and skirt 64 along flanges 76*b*. With a plurality of substantially identical containers 20 in a stack, container 20 can be destacked by sliding in the direction of arrow A. Container 20 is thus offset from the stack and the operator can lift container 20 by grasping central handles 92, 94. Offsetting container 20 from the stack before lifting can allow the operator to remain substantially upright, without bending, when lifting the container. Alternatively, container 20 can be seated in the sliding position and then urged in the direction of arrow B for stacking, again allowing the operator to remain substantially upright.

In the second stacked position, shown in FIGS. 12*a* to 12*d*, container 20 is stacked with container 20*b* such that sidewall 28 is aligned with sidewall 28*b*. Likewise, sidewall 32 is aligned with sidewall 32*b*. On each of sidewall pairs 28, 28*b* and 32, 32*b*, guide foot 116 is seated on complimentary rail depression 144*b*. Guide foot 120 is seated on complimentary rail depression 148*b*. Bevelled edge 126 of guide foot 120 is adjacent to bevelled edge 152*b* of depression 148*b*. Runner 132 is adjacent rail edge 140*b*. Guide foot 116 is aligned with guide foot 116*b* and guide foot 120 is aligned with guide foot 120*b*. Runner 132 is aligned with runner 132*b*. In this configuration, central handle 92 is aligned with central handle 92*b*. Rectangular end handles 96 and 96*b* are aligned, triangular end handles 100 and 100*b* are aligned, and serrated edges 112 and 112*b* are aligned. Similarly, central handles 94 and 94*b* are aligned, rectangular handles 98 and 98*b* are aligned, and triangular handles 102 and 102*b* are aligned. The distance between base 24 and base 24*b* is greater in the second stacked position than in the first stacked position. As will now be apparent to those of skill in the art, a plurality of substantially identical containers 20 can be stacked together in the second stacked position.

Figure 12A:
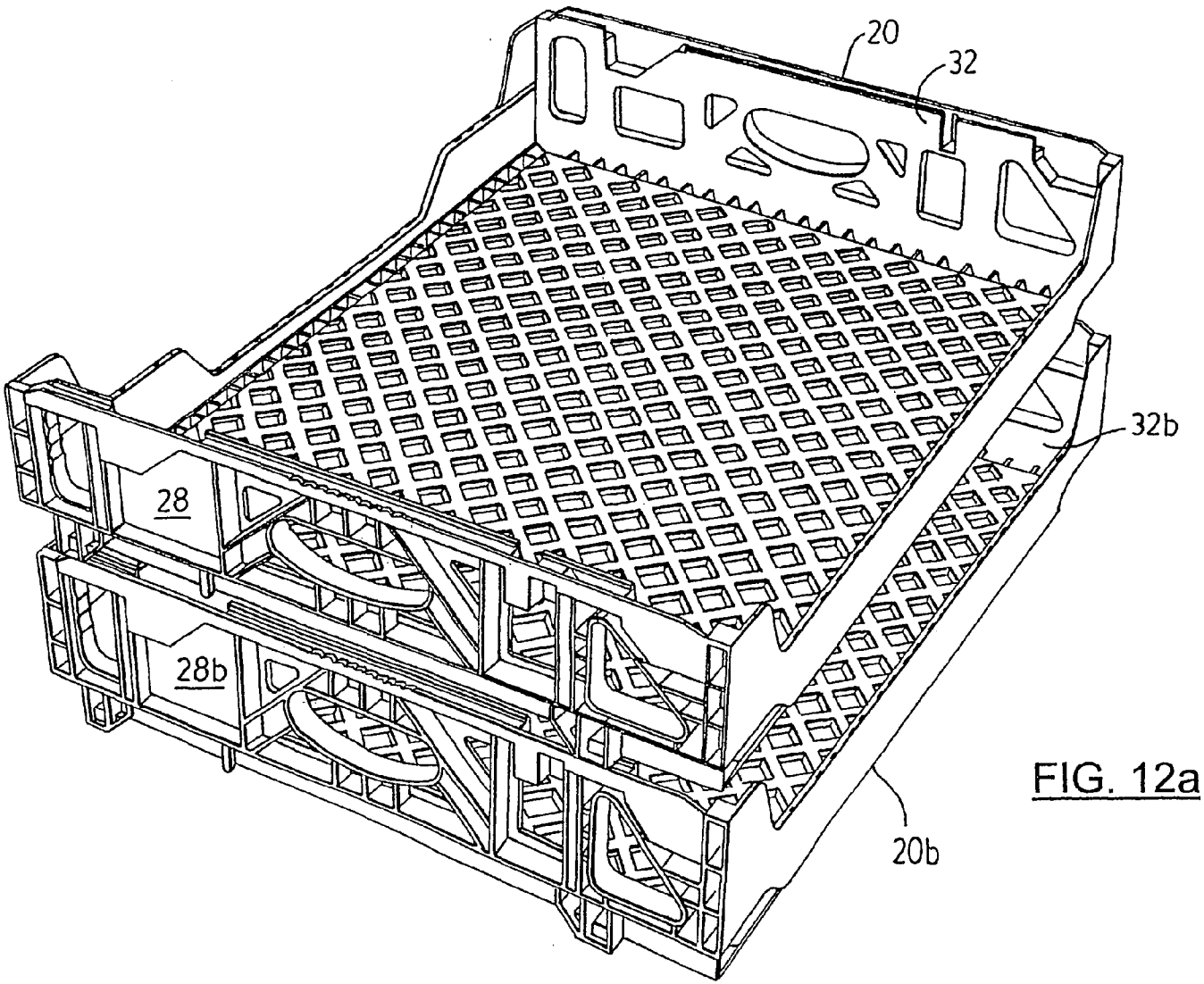
FIG. 12*a* is a top perspective view of two of the containers of FIG. 9*a* stacked in a second stacking position.
Figure 12B:
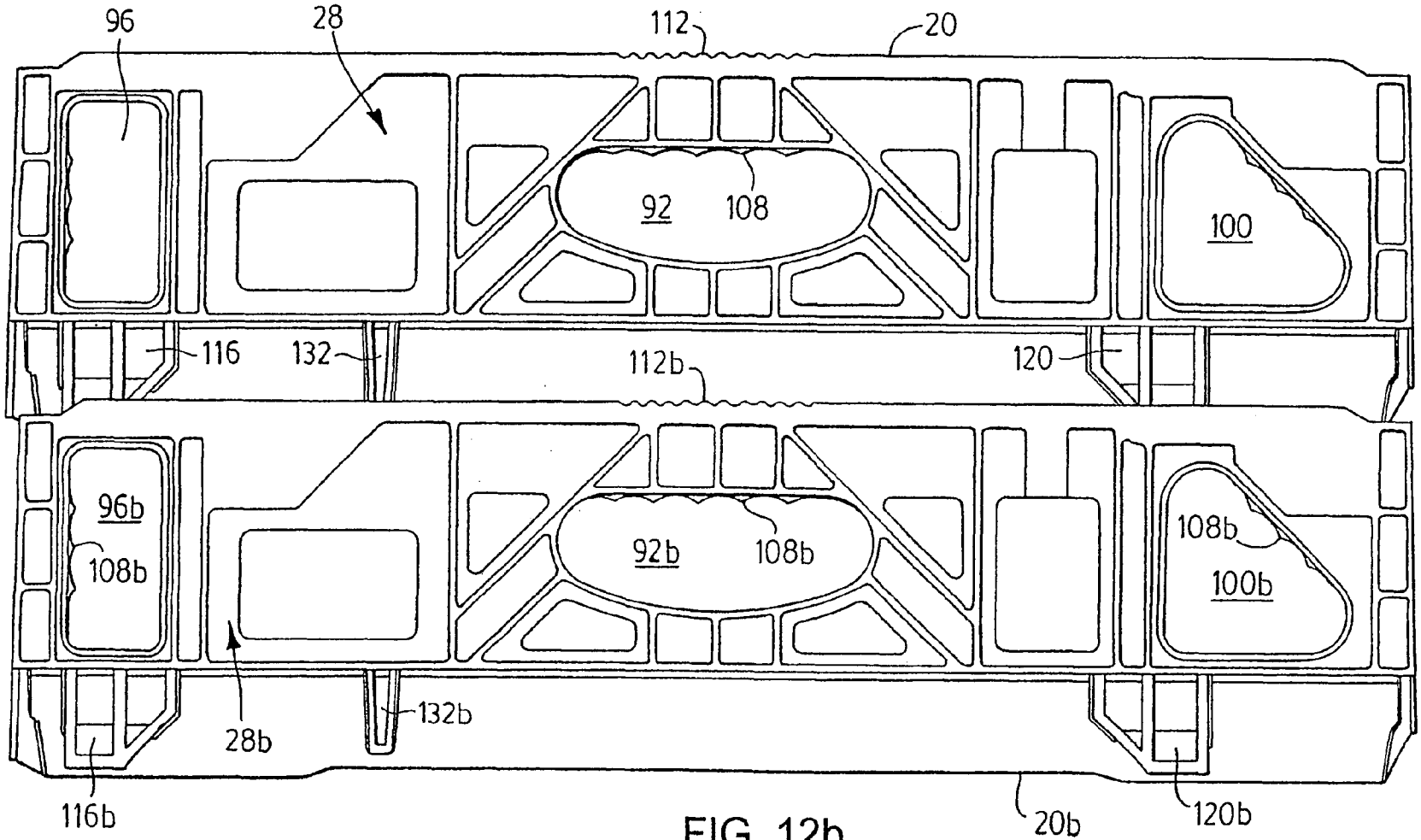
FIG. 12*b* is a side view of two of the containers stacked in the second stacking position.
Figure 12C:
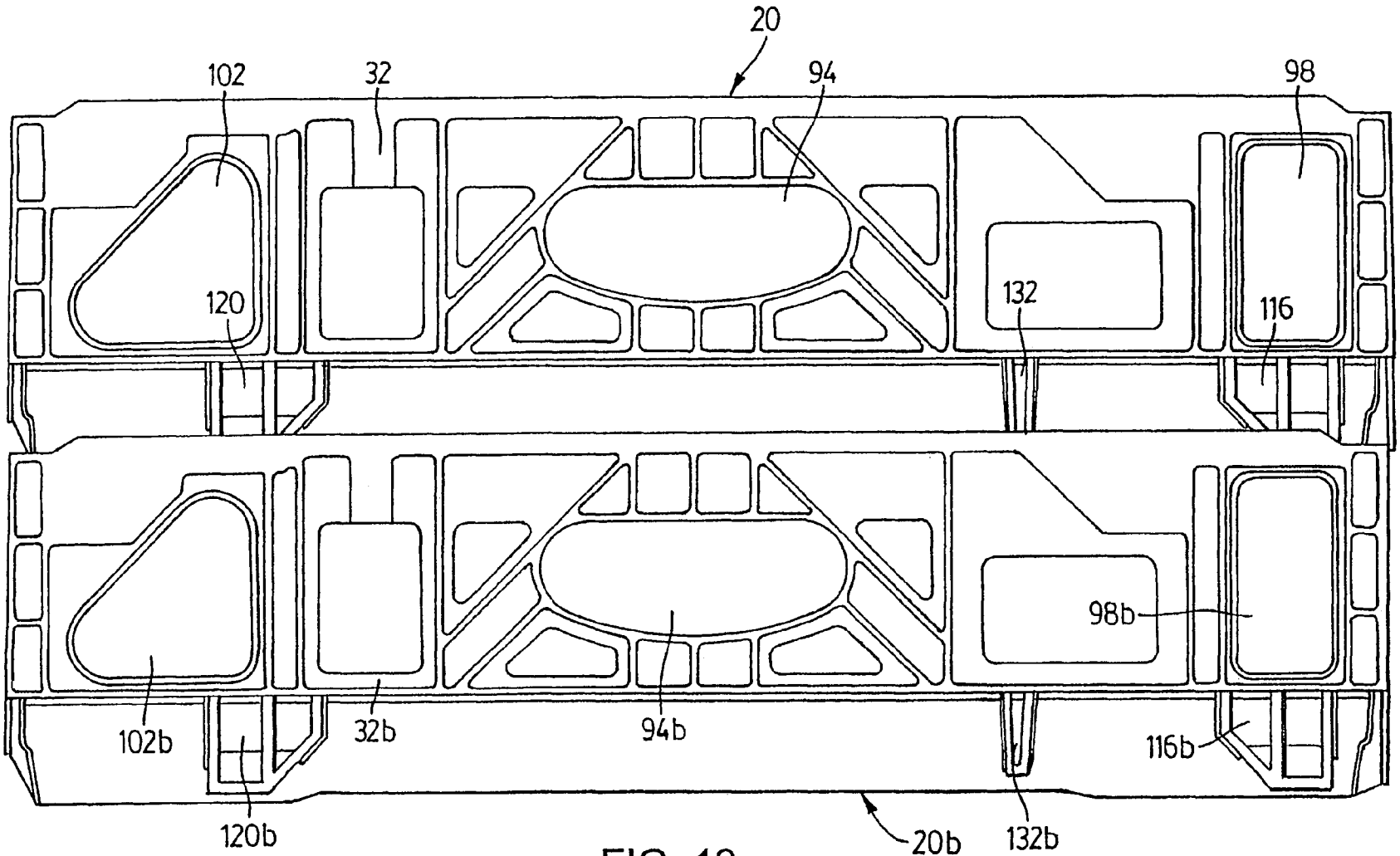
FIG. 12*c* is a side view of two of the containers, opposite the side view of FIG. 12*b*, stacked in the second stacking position.
Figure 12D:
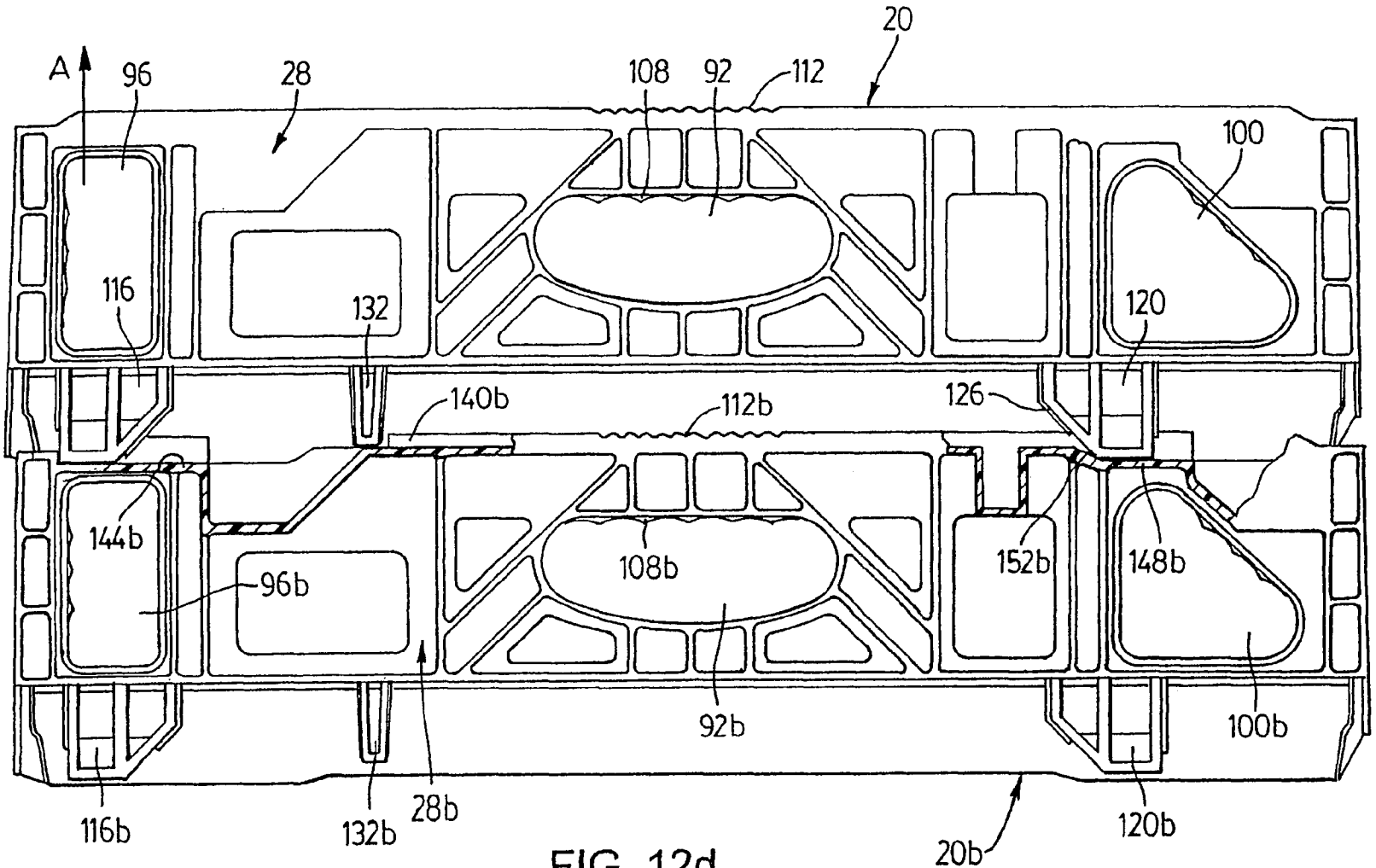
FIG. 12*d* is a partial sectional side view of two of the containers stacked in the second stacking position shown in FIG. 12*b;*
Figure 13:
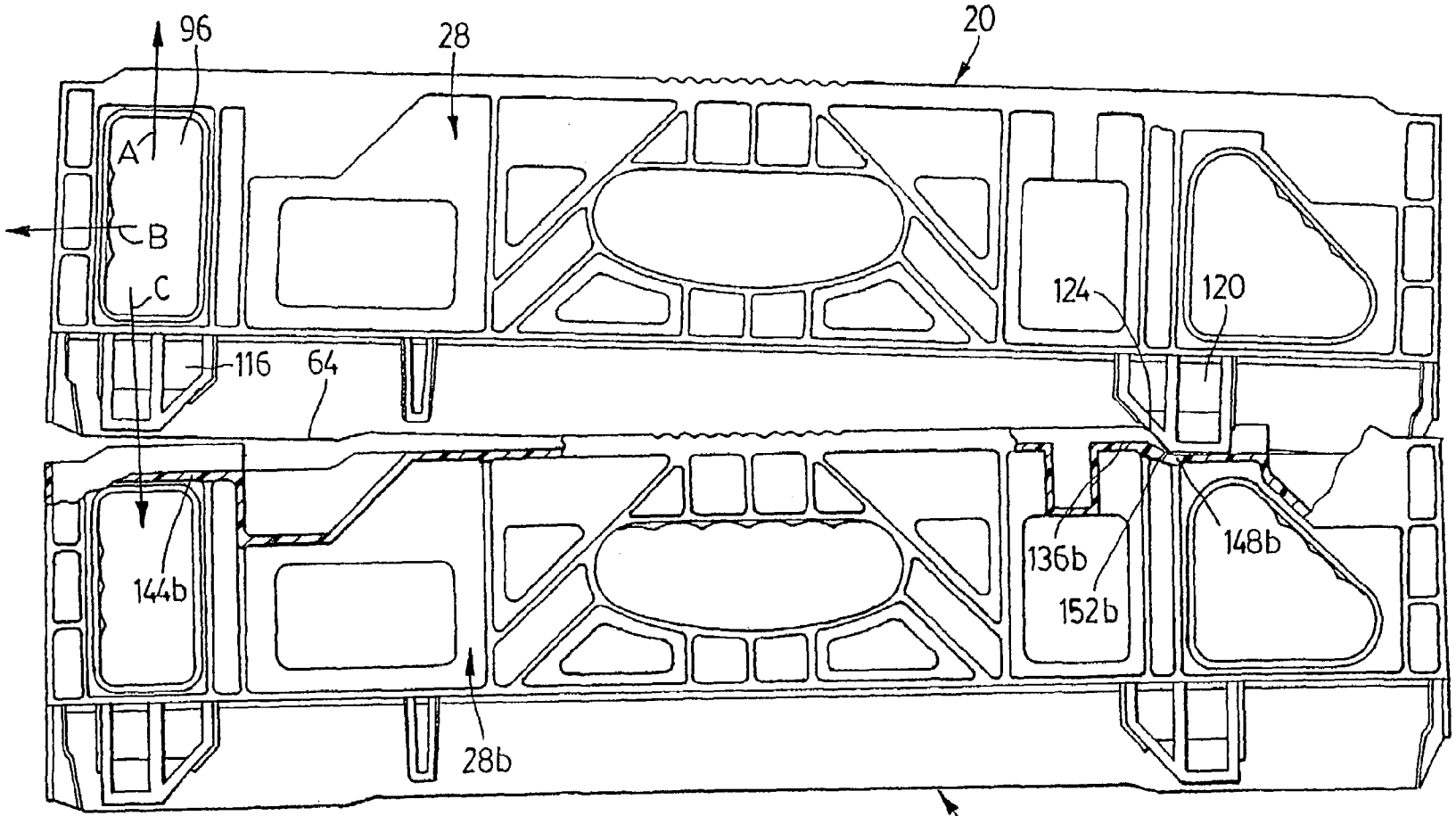
FIG. 13 is the partial sectional side view of FIG. 12*d* showing the first container in a second levered position with respect to the second container.
Figure 14:
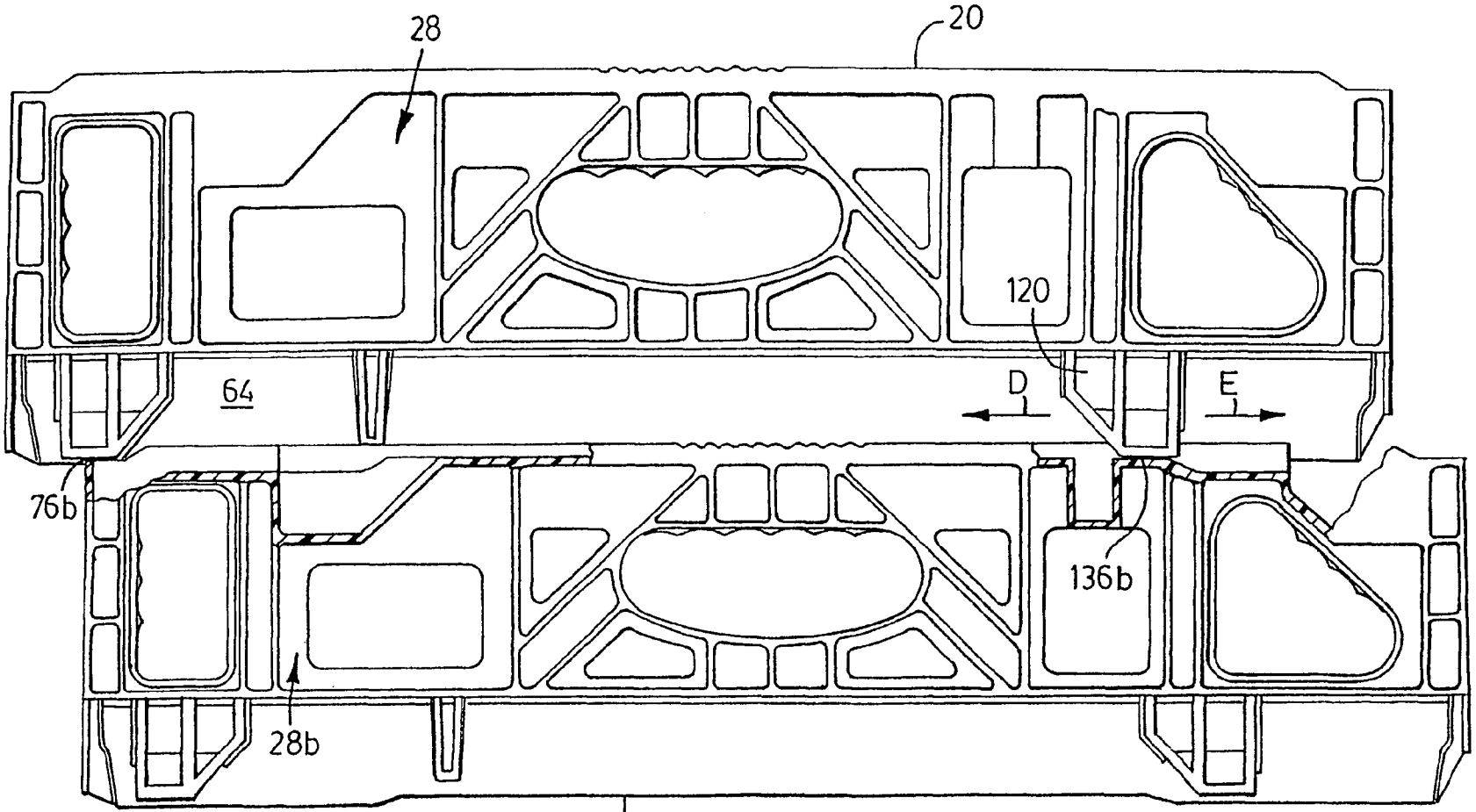
FIG. 14 is the partial sectional side view of FIG. 12*d* showing the first container in a first sliding position with respect to the second container.

Container 20 can be levered out of the second stacked position when destacking. From the second stacked position as shown in FIG. 12*d*, rectangular end handles 96, 98 are grasped and container 20 is urged in the direction of arrow A. On each of sidewall pairs 28, 28*b* and 32, 32*b*, second guide foot 120 maintains contact with depression 148*b* while first guide foot 116 is urged out of depression 144*b*. Referring to FIG. 13, container 20 is advanced in the direction of arrow B causing bevelled edge 124 of guide foot 120 to slide against bevelled edge 152*b* of depression 148*b*, thereby urging guide foot 120 out of depression 144*b* and onto rail 136*b*. Container 20 is then moved in the direction of arrow C. When container 20 is seated on container 20*b*, guide foot 120 is seated on rail 136*b* and skirt 64 is seated on flanges 76*b*, as best seen in FIG. 14. This is the second sliding position.

Referring now to FIG. 14, container 20 is in the second sliding position with guide foot 120 seated on rail 136*b* and skirt 64 seated on flanges 76*b*. Container 20 can be urged in the direction of arrow D for destacking or arrow E for stacking, by sliding guide foot 120 on rail 136*b* and skirt 64 on flanges 76*b*. With a stack of substantially identical containers 20, container 20 can be destacked by sliding in the direction of arrow D. Container 20 is thus offset from the stack and the operator can lift container 20 by grasping central handles 92, 94. Offsetting container 20 from the stack before lifting can allow the operator to remain substantially upright, without bending, when lifting the container. Alternatively, container 20 can be seated in the sliding position and then urged in the direction of arrow E for stacking. Seating the container in the sliding position before stacking, again, can allow the operator to remain substantially upright.

Figure 15A:
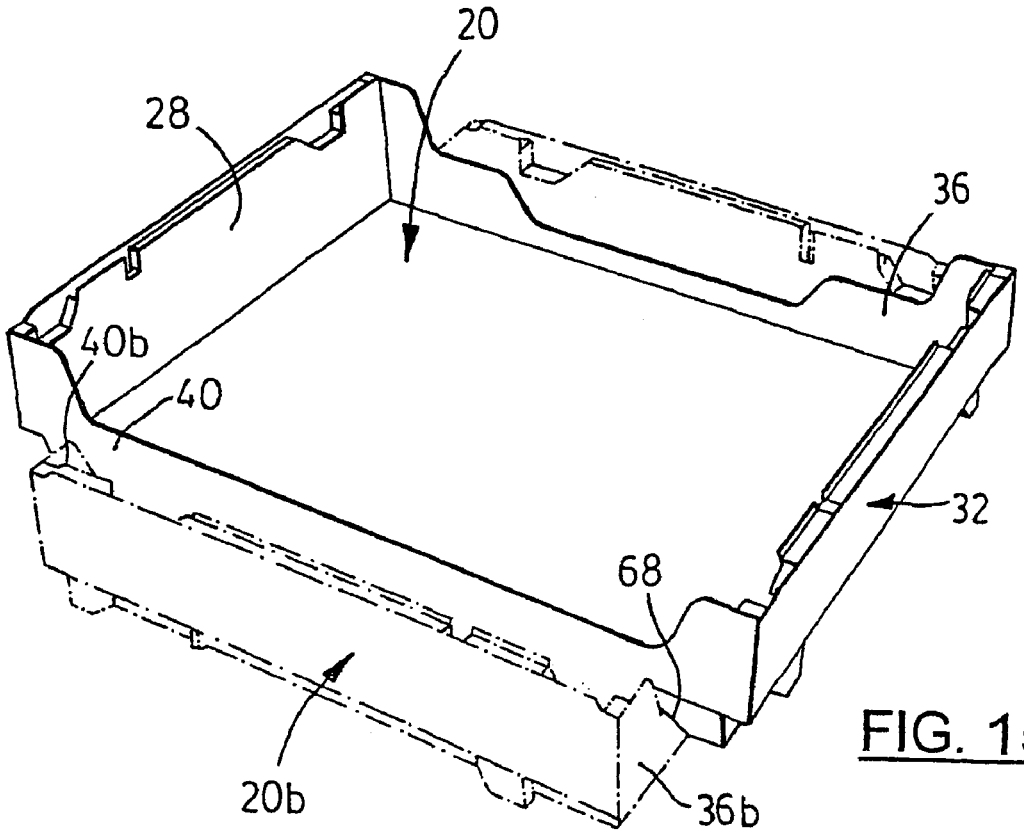
FIG. 15*a* is a top perspective view of the containers of FIG. 13*d* in a nested position.
Figure 15B:
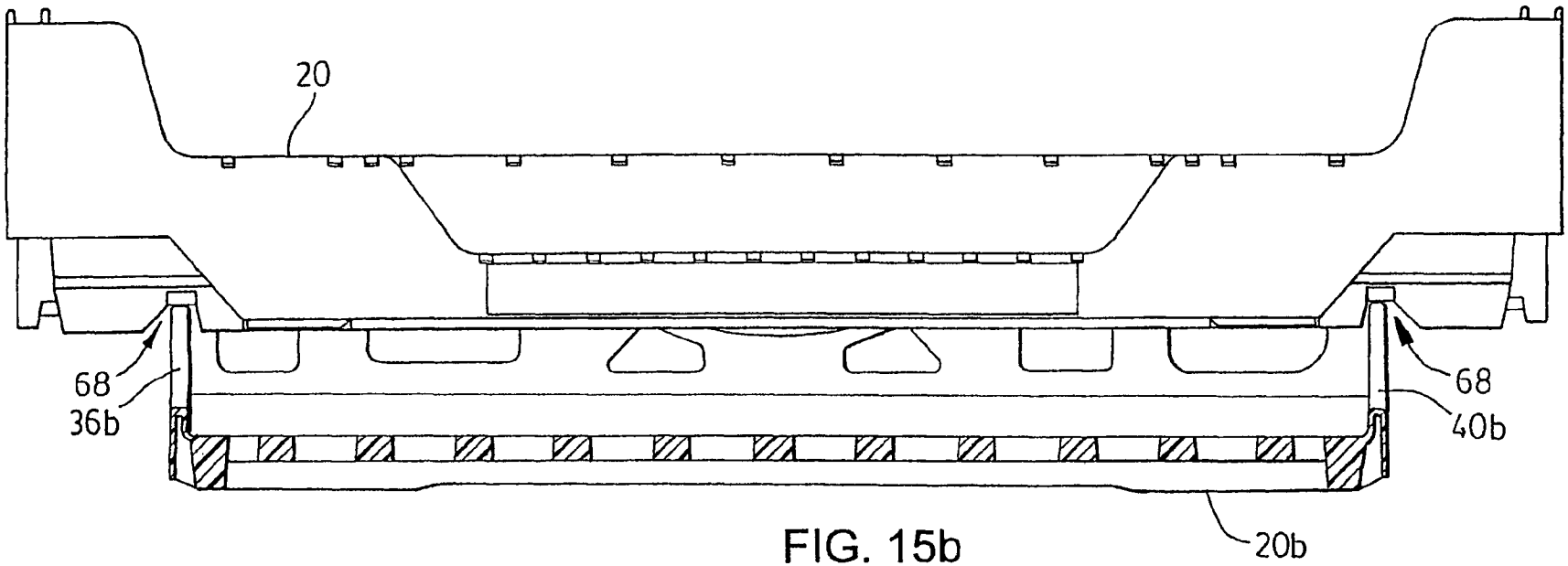
FIG. 15*b* is a sectional side view of the containers of FIG. 15*a* in the nested position.

In the nested position, shown in FIGS. 15*a* and 15*b*, container 20 is seated perpendicular to container 20*b*. Long sides 36*b*, 40*b* of container 20*b* are received by notches 68 of container 20. A stack of containers 20 in either stacked position can be lifted and moved using, for example, a two-wheeled cart. The blade of the cart is slideably received under skirt 64 of container 20 at taper 72. Tilting the cart thus lifts the stack of containers as base 24 and skirt 64 are in contact with the cart blade.

The stacking configuration of a plurality of containers 20 and the orientation of a container can be determined by the operator by using tactile or visual means. The operator can recognize sidewall 28 of container 20 by touching any of serrated edge 112 or finger grips 108 on each handle 92, 96, 100. Alternatively, the operator can recognize sidewall 28 of container 20 by visual recognition of the above mentioned features.

Figure 16:
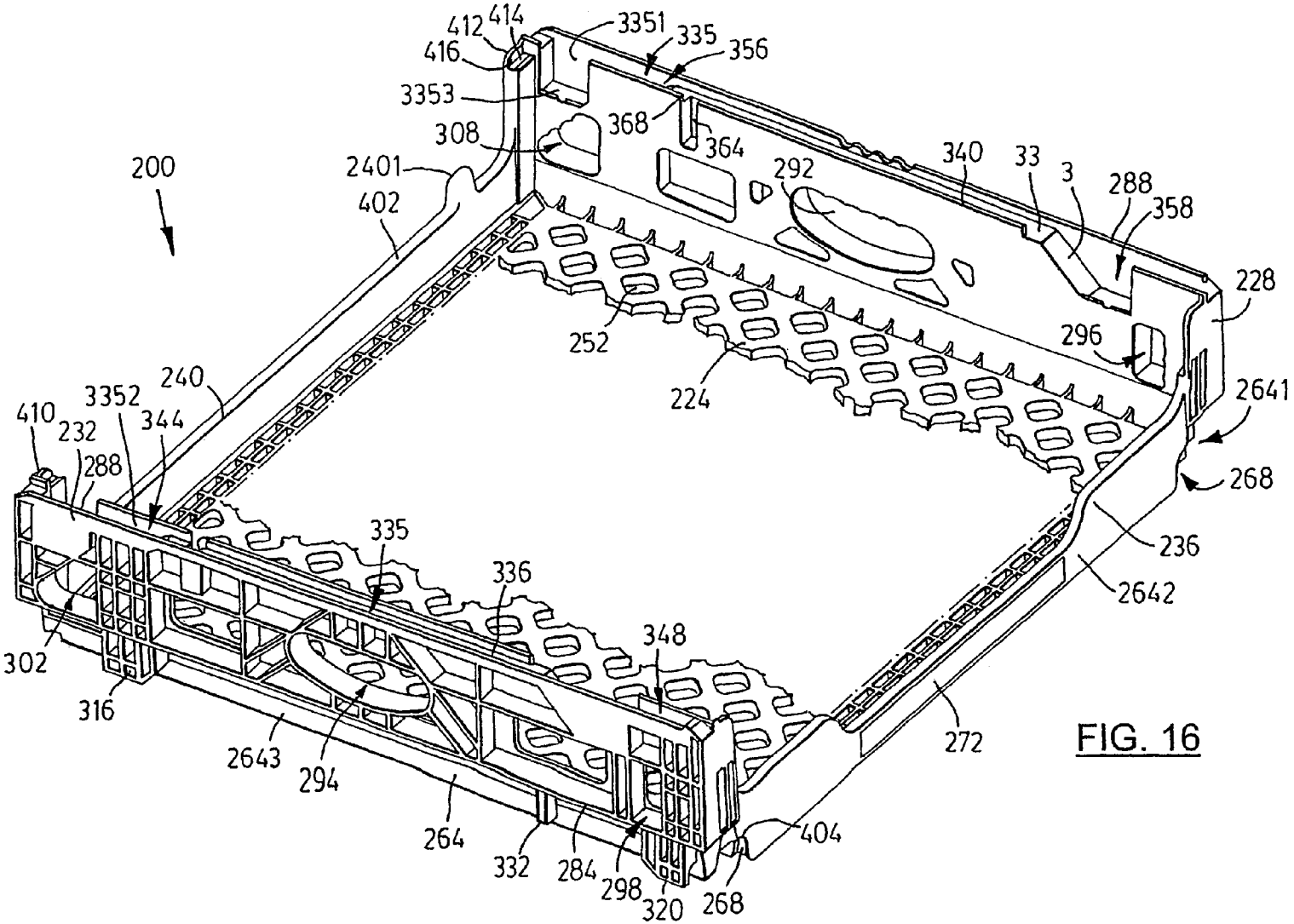
FIG. 16 is a top perspective view of a container of another embodiment of the present invention.

FIG. 16 illustrates another embodiment of the container of the present invention, and is generally indicated at 200. Container 200 is similar to container 20. Like container 20, container 200 includes a substantially rectangular base 224, a pair of opposed sidewalls 228, 232 that project normally to base 224 and a pair of opposed long sidewalls 236, 240 that also project substantially normal to base 224. Opposed long sidewalls 236, 240 extend between and merge with sidewalls 228, 232. Base 224 includes a plurality of apertures 252, one of which is relatively oversized to define a locator hole 253 (see FIG. 17).

Referring to FIG. 16, a skirt 264 runs along and extends from the periphery of base 224 and interconnects base 224 with sidewalls 228, 232 and long sidewalls 236, 240. Skirt 264 includes a first skirt section 2641, a second skirt section 2642, a third skirt section 2643, and a fourth skirt section 2644. Skirt section 2641 runs along sidewall 228 and interconnects sidewall 228 to base 224. Skirt section 2642 runs along long side 236 and interconnects sidewall 236 to base 224. Skirt section 2643 runs along sidewall 232 and interconnects sidewall 232 to base 224. Skirt section 2644 runs along long side 240 and interconnects sidewall 240 to base 224. Two notches 268 are formed along the bottom edge of skirt sections 2642 and 2644. Skirt 264 further includes an outward taper 272 that runs adjacent to long sides 236 and 240 and is provided for engaging the blade of a two-wheeled cart.

Sidewall 228 is formed with handles 292, 296, and 308. Similarly, sidewall 232 is formed with handles 294, 298, and 302.

Each of sidewalls 228 and 232 includes a base edge 284 and a first rail edge 288 opposite base edge 284. A first guide foot 316, a second guide foot 320, and a runner 332 are provided extending from base edge 284 of each sidewall 228 and 232. Runner 332 is disposed between first guide foot 316 and second guide foot 320. Sidewall 228 is substantially the mirror-image of sidewall 232.

A channel 335 is recessed from first rail edge 288 and extends substantially along the inner length of each sidewall 228 and 232. Each channel 335 includes inwardly facing sidewalls 3351 and 3352 extending from a track 3353. Each sidewall 3351 includes an upper edge, defining first rail edge 288. Similarly, each sidewall 3352 includes an upper edge, defining second rail edge 340. Each track 3353 includes a track surface 336, a first depression 344, a second depression 348, a first foot receptacle 356, a second foot receptacle 358, and a runner receptacle 364. First depression 344 is aligned with first guide foot 316. Second depression 348 is aligned with second guide foot 320. First foot receptacle 356 is proximal to long side 240, and is configured to receive first foot 316 of a second identical container 200. Second foot receptacle 358 is closer to central handle 292 or 294 than first foot receptacle 356, and is configured to receive second foot 320 of a second identical container 200. Runner receptacle 364 is configured to receive runner 332 of a second identical container 200. A fulcrum 368 is defined by the intersection of receptacle 364 and rail edge 340 on the side of receptacle 364 nearest central handle 292 or 294.

Long sidewall 236 includes an upper edge 402 and a lower edge 404. First foot 406 and second foot 408 extend from lower edge 404 at either end of long sidewall 236.

Figure 18:
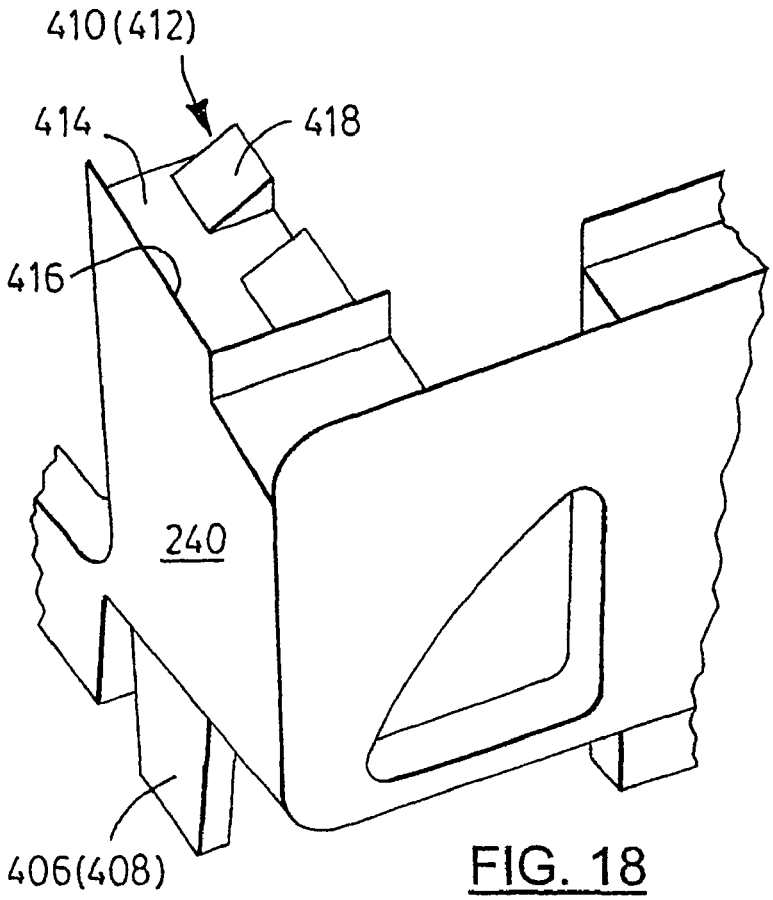
Figure 19:
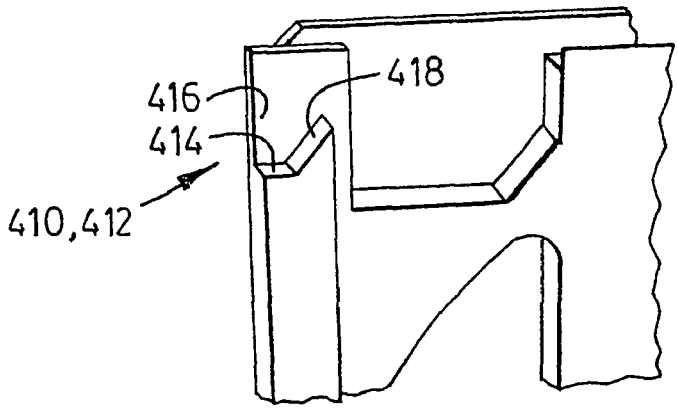

Referring to FIGS. 16, 18 and 19, long sidewall 240 includes a first support surface 410 and a second support surface 412, both disposed above base 224. Support surfaces 410, 412 are configured to provide seating and support for first foot 406 and second foot 408, respectively, of a second identical container 200. Each of support surfaces 410, 412 includes a floor 414 and an upstanding wall 416 extending from floor 414 and presenting a surface substantially parallel to that of long side 240. In this respect, wall 416 functions as a stop, for blocking lateral movement of first foot 406 or second foot 408. Spaced inwardly from and opposing wall 416, inclined surface or ramp 418 extends from floor 414, thereby impeding travel of first foot 406 or second foot 408 in the direction of inclined surface 418 and mitigating untimely unseating of first foot 406 or second foot 408 from support surfaces 410 and 412, respectively. Inclined surface 418 also facilitates seating and unseating of first foot 406 or second foot 408 with relative little difficulty.

Figure 17:
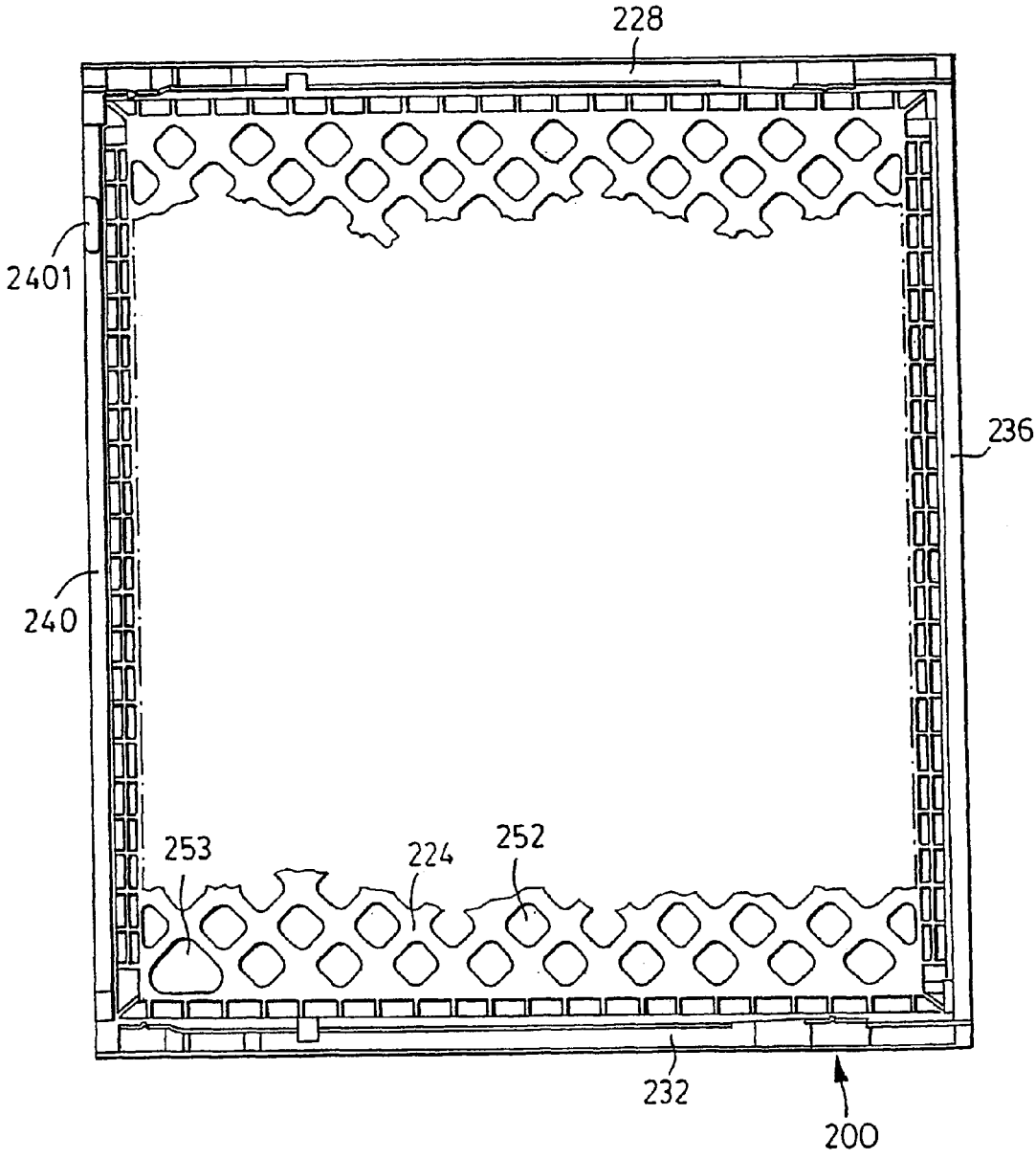
FIG. 17 is a top plan view of the container shown in FIG. 16.

Long sidewall 240 also includes a locator pin 2401, extending from upper edge 402 proximate to sidewall 228. Locator pin 2401 is trapezoidal-shaped and is configured to restrict the stacking of identical containers 200 to a single desired directional orientation. In this respect, of all the apertures 252, locator hole 253 is the only aperture 252 capable of receiving locator pin 2401. Referring to FIG. 17, locator hole 253 is disposed in base 224 of container 200, and configured to be located over locator pin 2401 of an identical container 200*b* to effect stacking of containers 200 and 200*b* in a desired directional orientation.

The positions for storage and transportation of container 200 will now be described. Container 200 is shown positioned with identical containers 200*b* and 200*c*. Note that all parts of containers 200*b* and 200*c* are given the same number designations as that of container 200 but are succeeded by the reference characters "b" and "c" respectively.

Figure 20:
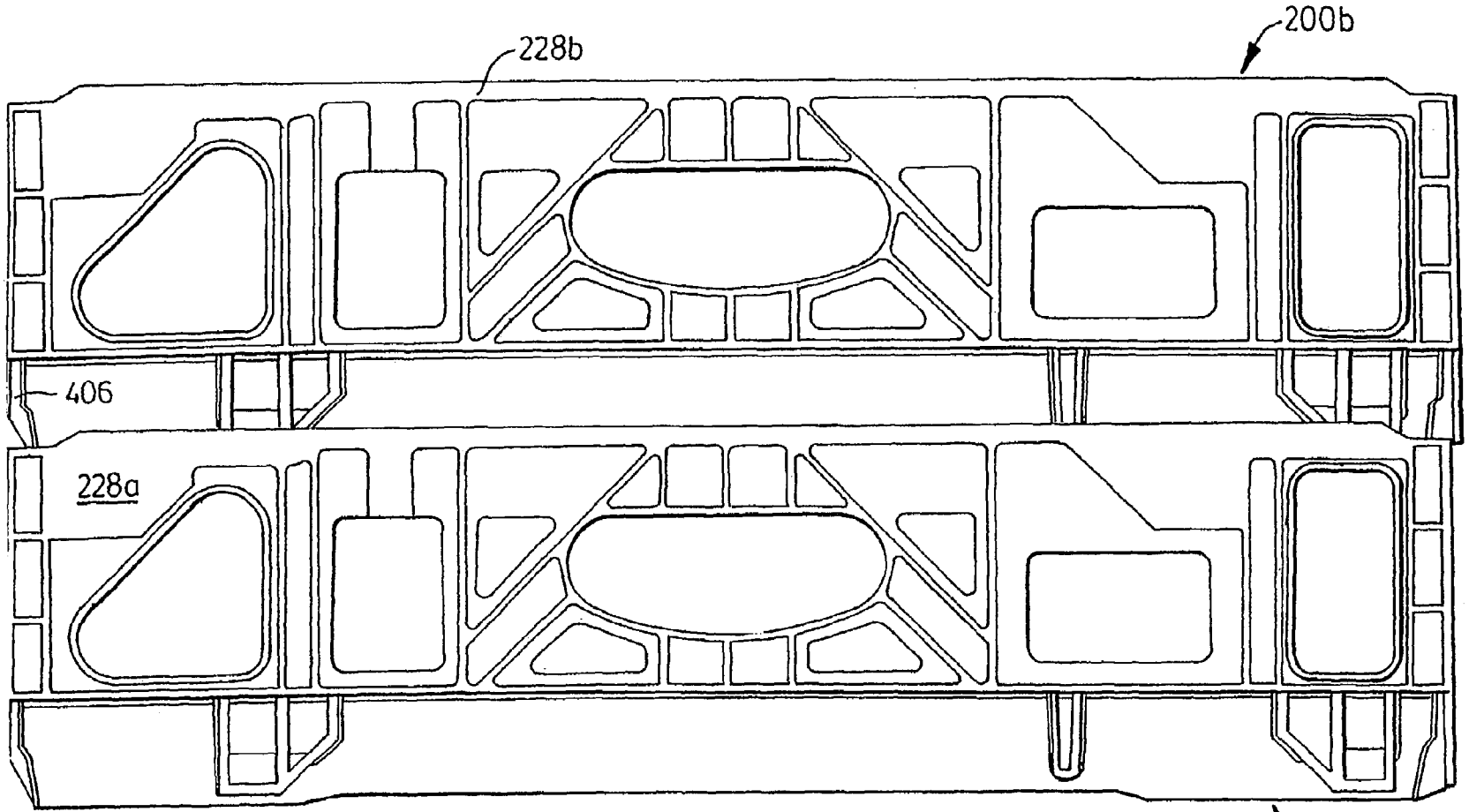
FIG. 20 is a side elevation view of two containers, identical to the container illustrated in FIG. 16, stacked in a stacking position.

Referring to FIG. 20, in a stacked position, container 200 is stacked with container 200*b* such that sidewall 228 is aligned with sidewall 228*b*. Likewise, sidewall 232 is aligned with sidewall 232*b*. This configuration is very similar to that illustrated in FIGS. 12*a* to 12*d* with the exception that first foot 404*b* and second foot 406*b* of second container 200*b* are seated upon support surfaces 410, 412, respectively, in the FIG. 20 embodiment.

Figure 21:
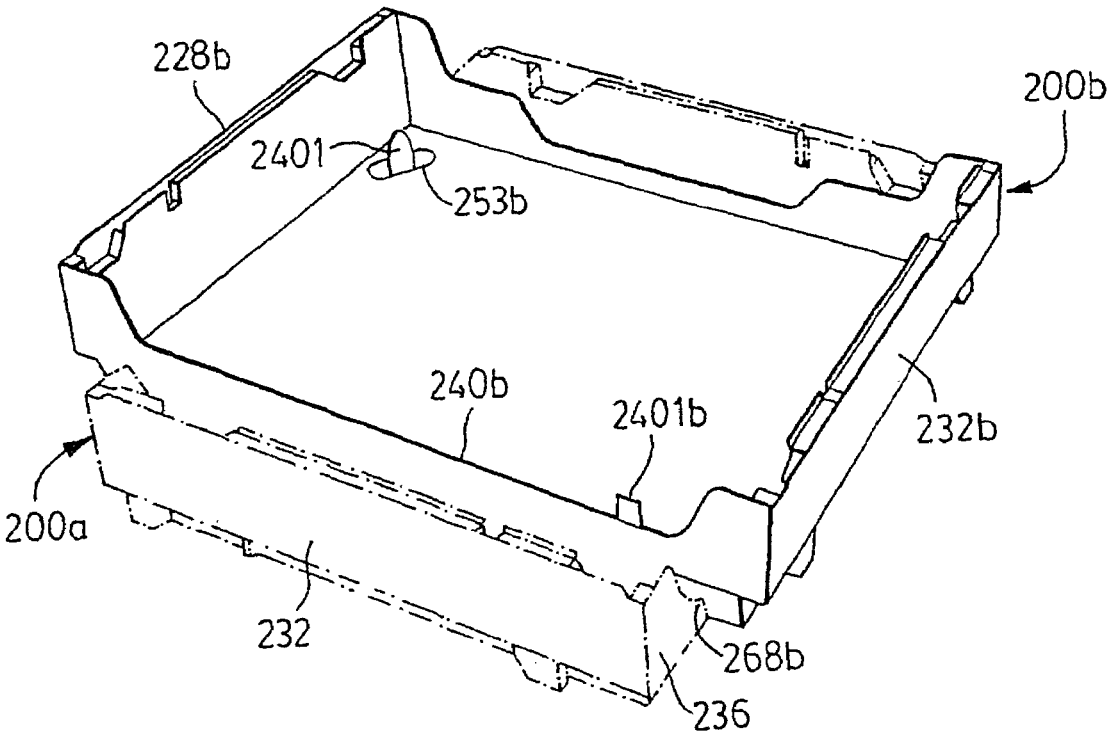
FIG. 21 is a top perspective view of two containers, identical to the container illustrated in FIG. 16, stacked in a nested position.

In the nested position, shown in FIG. 21 , container 200*b* is seated perpendicular to and upon container 200. In this respect, skirt section 2641 hangs over long sidewall 240, and sidewall 218 is substantially parallel with long sidewall 240. Similarly, skirt section 2642 hangs over long sidewall 236, and sidewall 232 is substantially parallel with long sidewall 236. Long sidewalls 236, 240 of container 200 are received by notches 268*b* of container 200*b* to stabilize the stacked/nested configuration. Locator pin 2401 is received by locator hole 253*b* to effect the above described orientation of container 200*b* relative to container 200. A third container 200*c* can then be seated perpendicular to container 200*b*, in a manner similar to that described above with respect to containers 200 and 200*b*, by positioning locator hole 253*c* over locator pin 2401 and receiving long sidewalls 236*b* and 240*b* within notches 268*c*. The resultant orientation of container 200*c* relative to container 200 dictates that first foot 316*c* is received by first foot receptacle 356, second foot 320*c* is received by second foot receptacle 358, and runner 332 is received by runner receptacle 364. Similarly, first foot 404*c* and second foot 406*c* are seated upon support surfaces 410 and 412 respectively. Such configuration minimizes stacking height of containers 200, 200*b*, and 200*c*.

Containers 200, stacked in this manner, can be lifted and moved using, for example, a two-wheeled cart. The blade of the cart is slideably received under skirt 64 of container 200 at taper 72, and particularly under the section of skirt 264 running adjacent to long side 236. Tilting the cart thus lifts the stack of containers as base 224 and skirt 264 are in contact with the cart blade. Interaction between first foot 404 and second foot 406 with support surfaces 410 and 412 mitigate the possibility of containers 200 losing their stacking relationship with one another as the cart is tilted.

In a presently preferred embodiment, the first stacking position can be used for transportation and storage of buns such as hot dog or hamburger buns. The second stacking position can be used for the transportation and storage of loaves of bread. Alternatively, the container can be used for the storage and transportation of other goods such as produce or sweet goods eg. cakes.

While the embodiments discussed herein are directed to particular implementations of the present invention, it will be apparent that the subsets and variations to these embodiments are within the scope of the invention. For example, the size of the sidewalls or long sides can differ from above or may all be equal in length. Alternatively, the feet and runner positions may be interchanged with the rail, rail edge and receptacles such that the feet and runner are on the edge of the sidewall distal to the base and the rail, rail edge and receptacles may be on the edge of the sidewall adjacent the base. The container may have only one stacking position when stacked with an identical container. Also, the container may or may not have a merchandiser window on either or both of the long sides. The container may have a logotype on one side and not the other for easy identification of the stacking position. Other ribs may be added or a different arrangement of ribs may be present on the sides of the container for additional strength and rigidity. The shape of any of the features can differ while still performing the same function. Furthermore, collectively, runner 132 and feet 116, 120 can be considered to be a plurality of runners.

The present invention provides a novel container for transport or storage of products such as bread, buns, or other goods. In one embodiment, there is provided a nestable container with a base and sidewalls that can be stacked in two positions for different products and can be nested when empty for compact storage. The container has levered positions for lifting out of each stacking position and into a corresponding sliding position. The sliding positions can be used to offset the container or containers from the stack and can allow the operator to remain substantially upright, without bending, and can thus reduce the back strain on the operator when lifting for destacking. Alternatively, the container can slide in the opposite direction for stacking in either position. Thus the operator can set the container down (on the uppermost container of the stack, and offset therefrom) into the sliding position and then slide the container into the stacking position. Back strain can be reduced during stacking and destacking as the operator does not have to extend or lean over the stack to pick up or set down the containers. The container has a serrated edge on one sidewall and finger grips on each handle of the same sidewall. Thus, the orientation of the container or stacking configuration of a plurality of containers is easily recognized by either tactile or visual means. The container has a skirt with a tapered section around the periphery of the base for slideably receiving a cart when moving containers. Thus the stack of containers does not require awkward tilting and manoeuvring of the cart. Also, the front of the containers is not damaged from frequent impact with the edge of a two-wheeled cart. The base of the container is slightly bowed so that the interior is convex and is comprised of many interconnected tapered u-shaped channels. The bowed base and the tapered channels increase the strength and resistance to deformation of the base. When lifting these containers with a two-wheeled cart, pressure is applied to the base of the container. The increased strength of the base can reduce damage to the contained goods.

I claim:

1. A container comprising:

a base;

at least one pair of opposing sidewalls projecting normally from said base, said sidewalls including a pair of stacking feet, each of said stacking feet including a first and second substantially vertical surface, a substantially horizontal surface substantially orthogonal to and joined to the first substantially vertical surface, and an angled portion joined at a first end to the second substantially vertical surface and joined at a second end to the substantially horizontal surface, and a pair of stacking feet receptacles, said stacking feet receptacles configured to receive the stacking feet and including an angled portion substantially similar to the angled portion of each of a corresponding stacking foot;

at least one pair of opposing longwalls projecting normally from said base;

each of said sidewalls further including a channel defining a rail edge distal from said base and having a plurality of runner receptacles;

said sidewalls having runners complementary to said runner receptacles and projecting from an edge adjacent to said base; and a fulcrum at a junction of said rail edge and one of said runner receptacles and substantially centrally located between a center of the sidewall and one longwall such that said container has a stacked position with an identical container when said runners are received in complementary runner receptacles of said identical container, a sliding position when at least one of said runners is received within a channel of said identical container, a levered position intermediate said stacked and sliding positions when said runner is pivoted with respect to a fulcrum of said identical container, and a lifted position intermediate the stacked and levered position, wherein the container is lifted upwardly by the longwall furthest from said fulcrum to rotate the container about the stacking feet located closest to the fulcrum as a result of the angled portion of the stacking foot sliding with respect to the angled portion of the corresponding stacking foot receptacle.

2. The container according to claim 1 having a second stacked position with said identical container wherein said runners are received in complementary runner receptacles of an opposite one of said sidewalls of said identical container.

3. The container according to claim 2 wherein said first stacked position has a different height between said base and a base of said identical container than said second stacked position.

4. The container according to claim 3 wherein said first stacked position is for transportation and storage of buns and said second stacked position is for transportation and storage of bread.

5. The container according to claim 2 wherein said container has a second sliding position when said runners abut said rail edge on said opposite one of said sidewalls of said identical container.

6. The container according to claim 5 wherein said container has a second levered position intermediate to said second stacked and said second sliding position when one of said runners respective to one of said receptacles on said opposite one of said sidewalls of said second container is pivoted thereon.

7. The container according to claim 2 wherein each of said opposing sidewalls has at least one handle, said handle having finger grips on one of said opposing sidewalls for determining orientation of said container when stacked with said second identical container.

8. The container according to claim 2 wherein one of said opposing sidewalls has a serrated edge, said serrated edge for determining orientation of said container when stacked with said second identical container.

9. The container according to claim 1 wherein said container further comprises:

a skirt around the periphery of said base, interconnecting said base with said sidewalls.

10. The container according to claim 7 wherein said skirt has an outward taper for slidably receiving the lifting edge of a cart when moving said container.

11. The container according to claim 1 wherein said container further comprises:

a pair of long walls projecting normally from said base, extending between said one pair of said opposing sidewalls; and a skirt around the periphery of said base, interconnecting said base with said sidewalls and said base with said long walls;

said skirt having a plurality of notches for receiving said long walls of said second container when said container is seated perpendicular to said second container.

12. The container according to claim 11 wherein at least one of said long walls frames a merchandiser window.

13. The container according to claim 1 wherein said base is comprised of a grid of interconnected, inverted u-shaped channels, said u-shaped channels having at least one closed end and two opposing sides.

14. The container according to claim 13 wherein said u-shaped channels are tapered such that each of said opposing sides form an angle of from about one degree to about fifteen degrees from the normal of said closed end.

15. The container according to claim 13 wherein said u-shaped channels are tapered such that each of said opposing sides form an angle of from about two degrees to about ten degrees from the normal of said closed end.

16. The container according to claim 13 wherein said u-shaped channels are tapered such that each of said opposing sides form an angle of about three degrees from the normal of said closed end.

17. The container according to claim 1 wherein said channel includes a web and a pair of opposing sides extending therefrom for guided travel of said runners within the channel.

18. A container comprising:

a base, including a support surface for supporting goods and a locator hole;

a first pair of opposed sidewalls projecting from the base, each of the sidewalls of the first pair including;

a channel, distal from said base, a plurality of stacking feet, wherein each stacking foot includes a first and second substantially vertical surface, a substantially horizontal surface substantially orthogonal to and joined to the first substantially vertical surface, and an angled portion joined at a first end to the second substantially vertical surface and joined at a second end to the substantially horizontal surface, and a pair of stacking feet receptacles, said stacking feet receptacles configured to receive the stacking feet and including an angled portion substantially similar to the angled portion of each of a corresponding stacking foot;

a plurality of runner receptacles, and runners projecting from an edge adjacent to said base, wherein the runners are received within a channel of an identical container and are complementary to said runner receptacles, a third side wall, projecting from the base and extending between the first and second sidewalls;

a fulcrum at a junction of said rail edge and one of said runner receptacles and substantially centrally located between a center of the sidewall and the third sidewall; and a locator pin projecting from said base so as not to interfere with the supporting of the goods by said base, said locator pin configured to be received within a locator hole of an identical container when said identical container is nested with said container;

wherein said locator pin and said locator hole of said identical container co-operate to effect said nesting of said identical container upon said container in a single predetermined transverse directional orientation relative to said container.

19. A container comprising:

a base comprising a grid of interconnected, inverted u-shaped channels, said u-shaped channels having at least one closed end and two opposing sides;

at least one pair of opposing sidewalls projecting normally from said base;

each of said sidewalls including a channel defining a rail edge distal from said base and having a plurality of receptacles;

said sidewalls having runners complementary to said receptacles and projecting from an edge adjacent to said base; and a fulcrum at a junction of said rail edge and one of said receptacles and substantially centrally located between a center of the sidewall and one longwall such that said container has a stacked position with an identical container when said runners are received in complementary receptacles of said identical container, a sliding position when at least one of said runners is received within a channel of said identical container and a levered position intermediate said stacked and sliding positions when said runner is pivoted with respect to a fulcrum of said identical container.

20. The container according to claim 19 having a second stacked position with said identical container wherein said runners are received in complementary receptacles of an opposite one of said sidewalls of said identical container.

21. The container according to claim 20 wherein said first stacked position has a different height between said base and a base of said identical container than said second stacked position.

22. The container according to claim 21 wherein said first stacked position is for transportation and storage of buns and said second stacked position is for transportation and storage of bread.

23. The container according to claim 20 wherein said container has a second sliding position when said runners abut said rail edge on said opposite one of said sidewalls of said identical container.

24. The container according to claim 23 wherein said container has a second levered position intermediate to said second stacked and said second sliding position when one of said runners respective to one of said receptacles on said opposite one of said sidewalls of said second container is pivoted thereon.

25. The container according to claim 20 wherein each of said opposing sidewalls has at least one handle, said handle having finger grips on one of said opposing sidewalls for determining orientation of said container when stacked with said second identical container.

26. The container according to claim 20 wherein one of said opposing sidewalls has a serrated edge, said serrated edge for determining orientation of said container when stacked with said second identical container.

27. The container according to claim 19 wherein said container further comprises; a skirt around the periphery of said base, interconnecting said base with said sidewalls.

28. The container according to claim 27 wherein said skirt has an outward taper for slidably receiving the lifting edge of a cart when moving said container.

29. The container according to claim 19 wherein said container further comprises:

a pair of long walls projecting normally from said base, extending between said one pair of said opposing sidewalls; and a skirt around the periphery of said base, interconnecting said base with said sidewalls and said base with said long walls;

said skirt having a plurality of notches for receiving said long walls of said second container when said container is seated perpendicular to said second container.

30. The container according to claim 29 wherein at least one of said long walls frames a merchandiser window.

31. The container according to claim 19 wherein said u-shaped channels are tapered such that each of said opposing sides form an angle of from about one degree to about fifteen degrees from the normal of said closed end.

32. The container according to claim 19 wherein said u-shaped channels are tapered such that each of said opposing sides form an angle of from about two degrees to about ten degrees from the normal of said closed end.

33. The container according to claim 19 wherein said u-shaped channels are tapered such that each of said opposing sides form an angle of about three degrees from the normal of said closed end.

34. The container according to claim 19 wherein said channel includes a web and a pair of opposing sides extending therefrom for guided travel of said runners within the channel.

* * * * *